US009064479B2

(12) United States Patent
Yui et al.

(10) Patent No.: US 9,064,479 B2
(45) Date of Patent: Jun. 23, 2015

(54) TUNING DEVICE

(71) Applicant: ROLAND CORPORATION, Shizuoka (JP)

(72) Inventors: Hirofumi Yui, Shizuoka (JP); Shohei Okumura, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 133 days.

(21) Appl. No.: 14/013,041

(22) Filed: Aug. 29, 2013

(65) Prior Publication Data

US 2014/0137720 A1 May 22, 2014

(30) Foreign Application Priority Data

Nov. 19, 2012 (JP) ..... 2012-253155

(51) Int. Cl.
*G10G 7/02* (2006.01)

(52) U.S. Cl.
CPC ..... *G10G 7/02* (2013.01)

(58) Field of Classification Search
CPC ..... G10G 7/02
USPC ..... 84/454
See application file for complete search history.

(56) References Cited

U.S. PATENT DOCUMENTS

| | | | | |
|---|---|---|---|---|
| 5,427,011 | A | 6/1995 | Steinberger | |
| 5,877,443 | A * | 3/1999 | Arends et al. | 84/454 |
| 6,525,255 | B1 * | 2/2003 | Funaki | 84/616 |
| 8,334,449 | B2 * | 12/2012 | Nielsen et al. | 84/454 |
| 2007/0169612 | A1 * | 7/2007 | Miyazawa | 84/423 R |
| 2008/0047414 | A1 * | 2/2008 | Friedman et al. | 84/609 |

FOREIGN PATENT DOCUMENTS

| | | |
|---|---|---|
| JP | 2681432 | 11/1997 |
| JP | 2002-132256 | 5/2002 |
| JP | 4637341 | 2/2011 |
| WO | 2011018095 | 2/2011 |

* cited by examiner

*Primary Examiner* — Jianchun Qin
(74) *Attorney, Agent, or Firm* — Jianq Chyun IP Office

(57) ABSTRACT

A tuning device is provided for properly tuning two sounds that are produced simultaneously. According to the invention, a notification means is provided for notifying the user of information about a relative pitch difference value of a first pitch corresponding to a first pitch name and a second pitch corresponding to a second pitch name, which are among the pitches detected by a pitch detection means. Through the notification of the notification means, the user can check the relative pitch difference value of the two sounds that is displayed by a pitch name display means to properly tune the two sounds that are produced simultaneously.

8 Claims, 12 Drawing Sheets

| reference pitch name | range of the difference Δp of the pitch of the input sound relative to the reference pitch | luminance L (%) of each indicator of the pitch name display | | | | | | |
|---|---|---|---|---|---|---|---|---|
| | | … | B | C | C # | D | D # | … |
| ⋮ | ⋮ | … | ⋮ | ⋮ | ⋮ | ⋮ | ⋮ | … |
| C | −(Q2/2) cent ≦ Δp < −10cent | … | 80 ≧ L > 0 | 80 ≦ L < 100 | 0 | 0 | 0 | … |
| | −10cent ≦ Δp ≦ +10cent | | 0 | 100 | 0 | 0 | 0 | |
| | +10cent < Δp < +(Q3/2) cent | | 0 | 100 > L > 80 | 0 < L < 80 | 0 | 0 | |
| C # | −(Q3/2) cent ≦ Δp < −10cent | … | 0 | 80 ≧ L > 0 | 80 ≦ L < 100 | 0 | 0 | … |
| | −10cent ≦ Δp ≦ +10cent | | 0 | 0 | 100 | 0 | 0 | |
| | +10cent < Δp < +(Q4/2) cent | | 0 | 0 | 100 > L > 80 | 0 < L < 80 | 0 | |
| D | −(Q4/2) cent ≦ Δp < −10cent | … | 0 | 0 | 80 ≧ L > 0 | 80 ≦ L < 100 | 0 | … |
| | −10cent ≦ Δp ≦ +10cent | | 0 | 0 | 0 | 100 | 0 | |
| | +10cent < Δp < +(Q5/2) cent | | 0 | 0 | 0 | 100 > L > 80 | 0 < L < 80 | |
| ⋮ | ⋮ | … | ⋮ | ⋮ | ⋮ | ⋮ | ⋮ | … |

FIG. 2 cent difference per semitone according to equal temperament scale and just intonation scale (major)

| difference (semitone) | 0 | 1 | 2 | 3 | 4 | 5 | 6 | 7 | 8 | 9 | 10 | 11 | 12 |
|---|---|---|---|---|---|---|---|---|---|---|---|---|---|
| equal temperament | 0 | 100 | 200 | 300 | 400 | 500 | 600 | 700 | 800 | 900 | 1000 | 1100 | 1200 |
| just intonation (major) | 0 | 70.7 | 203.9 | 315.6 | 386.3 | 498.0 | 568.7 | 702.0 | 772.4 | 884.4 | 1017.6 | 1088.3 | 1200.0 |

FIG. 4A reference pitch of each pitch name unit (×N Hz ; N=…1/4, 1/2, 1, 2, 4…)

| | C | C# | D | D# | E | F | F# | G | G# | A | A# | B |
|---|---|---|---|---|---|---|---|---|---|---|---|---|
| equal temperament | 261.6 | 277.2 | 293.7 | 311.1 | 329.6 | 349.2 | 370.0 | 392.0 | 415.3 | 440.0 | 466.2 | 493.9 |
| just intonation (major) C | 261.6 | 272.5 | 294.3 | 314.0 | 327.0 | 348.8 | 363.4 | 392.4 | 408.8 | 436.0 | 470.9 | 490.5 |
| just intonation (major) C# | 259.9 | 277.2 | 288.7 | 311.8 | 332.6 | 346.5 | 369.6 | 385.0 | 415.8 | 433.1 | 462.0 | 498.9 |
| just intonation (major) D | 264.3 | 275.3 | 293.7 | 305.9 | 330.4 | 352.4 | 367.1 | 391.6 | 407.9 | 440.5 | 458.9 | 489.4 |
| just intonation (major) D# | 259.3 | 280.0 | 291.7 | 311.1 | 324.1 | 350.0 | 373.4 | 388.9 | 414.8 | 432.1 | 466.7 | 486.1 |
| just intonation (major) E | 257.5 | 274.7 | 296.7 | 309.0 | 329.6 | 343.4 | 370.8 | 395.6 | 412.0 | 439.5 | 457.8 | 494.4 |
| just intonation (major) F | 261.9 | 272.8 | 291.0 | 314.3 | 327.4 | 349.2 | 363.8 | 392.9 | 419.1 | 436.5 | 465.6 | 485.0 |
| just intonation (major) F# | 256.9 | 277.5 | 289.1 | 308.3 | 333.0 | 346.9 | 370.0 | 385.4 | 416.2 | 440.0 | 462.5 | 493.3 |
| just intonation (major) G | 261.3 | 272.2 | 294.0 | 306.2 | 326.7 | 352.8 | 367.5 | 392.0 | 408.3 | 441.0 | 470.4 | 490.0 |
| just intonation (major) G# | 259.6 | 276.9 | 288.4 | 311.5 | 324.5 | 346.1 | 373.8 | 389.3 | 415.3 | 432.6 | 467.2 | 498.4 |
| just intonation (major) A | 264.0 | 275.0 | 293.3 | 305.6 | 330.0 | 343.8 | 366.7 | 396.0 | 412.5 | 440.0 | 458.3 | 495.0 |
| just intonation (major) A# | 262.2 | 279.7 | 291.4 | 310.8 | 323.7 | 349.6 | 364.2 | 388.5 | 419.5 | 437.0 | 466.2 | 485.6 |
| just intonation (major) B | 257.2 | 277.8 | 296.3 | 308.7 | 329.3 | 343.0 | 370.4 | 385.8 | 411.6 | 444.5 | 463.0 | 493.9 |

keynote

FIG. 4B pitch name determining table for equal temperament (pitch name determining table H)

unit (×N Hz ; N=…1/4, 1/2, 1, 2, 4…)

| | C | C# | D | D# | E | F |
|---|---|---|---|---|---|---|
| equal temperament | 254.2<P≦269.3 | 269.3<P≦285.3 | 285.3<P≦302.3 | 302.3<P≦320.2 | 320.2<P≦339.3 | 339.3<P≦359.5 |

| | F# | G | G# | A | A# | B |
|---|---|---|---|---|---|---|
| equal temperament | 359.5<P≦380.8 | 380.8<P≦403.5 | 403.5<P≦427.5 | 427.5<P≦452.9 | 452.9<P≦479.8 | 479.8<P≦508.4 |

FIG. 4C pitch name determining table for just intonation (pitch name determining table J)

unit (×N Hz ; N=…1/4, 1/2, 1, 2, 4…)

| | C | C# | D | D# | E | F |
|---|---|---|---|---|---|---|
| just intonation (major) C | 253.3<P≦267.0 | 267.0<P≦283.2 | 283.2<P≦304.0 | 304.0<P≦320.4 | 320.4<P≦337.8 | 337.8<P≦356.0 |
| just intonation (major) C# | 254.6<P≦268.4 | 268.4<P≦282.9 | 282.9<P≦300.1 | 300.1<P≦322.1 | 322.1<P≦339.5 | 339.5<P≦357.8 |
| just intonation (major) D | 254.3<P≦269.7 | 269.7<P≦284.3 | 284.3<P≦299.7 | 299.7<P≦317.9 | 317.9<P≦341.2 | 341.2<P≦359.7 |
| just intonation (major) D# | 251.0<P≦269.4 | 269.4<P≦285.8 | 285.8<P≦301.2 | 301.2<P≦317.5 | 317.5<P≦336.8 | 336.8<P≦361.5 |
| just intonation (major) E | 252.3<P≦266.0 | 266.0<P≦285.5 | 285.5<P≦302.8 | 302.8<P≦319.2 | 319.2<P≦336.4 | 336.4<P≦356.8 |
| just intonation (major) F | 252.0<P≦267.3 | 267.3<P≦281.8 | 281.8<P≦302.4 | 302.4<P≦320.8 | 320.8<P≦338.1 | 338.1<P≦356.4 |
| just intonation (major) F# | 251.7<P≦267.0 | 267.0<P≦283.2 | 283.2<P≦298.5 | 298.5<P≦320.4 | 320.4<P≦339.9 | 339.9<P≦358.2 |
| just intonation (major) G | 253.0<P≦266.7 | 266.7<P≦282.9 | 282.9<P≦300.1 | 300.1<P≦316.3 | 316.3<P≦339.5 | 339.5<P≦360.1 |
| just intonation (major) G# | 254.3<P≦268.1 | 268.1<P≦282.6 | 282.6<P≦299.7 | 299.7<P≦317.9 | 317.9<P≦335.1 | 335.1<P≦359.7 |
| just intonation (major) A | 255.6<P≦269.4 | 269.4<P≦284.0 | 284.0<P≦299.4 | 299.4<P≦317.5 | 317.5<P≦336.8 | 336.8<P≦355.0 |
| just intonation (major) A# | 252.3<P≦270.8 | 270.8<P≦285.5 | 285.5<P≦300.9 | 300.9<P≦317.2 | 317.2<P≦336.4 | 336.4<P≦356.8 |
| just intonation (major) B | 252.0<P≦267.3 | 267.3<P≦286.9 | 286.9<P≦302.4 | 302.4<P≦318.8 | 318.8<P≦336.0 | 336.0<P≦356.4 |

| | F# | G | G# | A | A# | B |
|---|---|---|---|---|---|---|
| just intonation (major) C | 356.0<P≦377.6 | 377.6<P≦400.5 | 400.5<P≦422.2 | 422.2<P≦453.1 | 453.1<P≦480.6 | 480.6<P≦506.6 |
| just intonation (major) C# | 357.8<P≦377.2 | 377.2<P≦400.1 | 400.1<P≦424.3 | 424.3<P≦447.3 | 447.3<P≦480.1 | 480.1<P≦509.2 |
| just intonation (major) D | 359.7<P≦379.1 | 379.1<P≦399.6 | 399.6<P≦423.9 | 423.9<P≦449.6 | 449.6<P≦473.9 | 473.9<P≦508.6 |
| just intonation (major) D# | 361.5<P≦381.1 | 381.1<P≦401.7 | 401.7<P≦423.4 | 423.4<P≦449.1 | 449.1<P≦476.3 | 476.3<P≦502.1 |
| just intonation (major) E | 356.8<P≦383.0 | 383.0<P≦403.7 | 403.7<P≦425.5 | 425.5<P≦448.6 | 448.6<P≦475.8 | 475.8<P≦504.6 |
| just intonation (major) F | 356.4<P≦378.1 | 378.1<P≦405.8 | 405.8<P≦427.7 | 427.7<P≦450.9 | 450.9<P≦475.2 | 475.2<P≦504.1 |
| just intonation (major) F# | 358.2<P≦377.6 | 377.6<P≦400.5 | 400.5<P≦429.9 | 429.9<P≦453.1 | 453.1<P≦477.7 | 477.7<P≦503.5 |
| just intonation (major) G | 360.1<P≦379.5 | 379.5<P≦400.1 | 400.1<P≦424.3 | 424.3<P≦455.5 | 455.5<P≦480.1 | 480.1<P≦506.1 |
| just intonation (major) G# | 359.7<P≦381.5 | 381.5<P≦402.1 | 402.1<P≦423.9 | 423.9<P≦449.6 | 449.6<P≦482.5 | 482.5<P≦508.6 |
| just intonation (major) A | 355.0<P≦381.1 | 381.1<P≦404.2 | 404.2<P≦426.0 | 426.0<P≦449.1 | 449.1<P≦476.3 | 476.3<P≦511.2 |
| just intonation (major) A# | 356.8<P≦376.1 | 376.1<P≦403.7 | 403.7<P≦428.2 | 428.2<P≦451.4 | 451.4<P≦475.8 | 475.8<P≦504.6 |
| just intonation (major) B | 356.4<P≦378.1 | 378.1<P≦398.5 | 398.5<P≦427.7 | 427.7<P≦453.7 | 453.7<P≦478.2 | 478.2<P≦504.1 |

FIG. 5 auxiliary display table for equal temperament (auxiliary display table H) unit (cent)

| ♭ indicator light-on<br># indicator light-off | ♭ indicator light-on<br># indicator light-on | ♭ indicator light-off<br># indicator light-on | ♭ indicator light-off<br># indicator light-off |
|---|---|---|---|
| | 0≦Δc≦5 | 5<Δc≦40 | 40<Δc<60 |
| 60≦Δc<95 | 95≦Δc≦105 | 105<Δc≦140 | 140<Δc<160 |
| 160≦Δc<195 | 195≦Δc≦205 | 205<Δc≦240 | 240<Δc<260 |
| 260≦Δc<295 | 295≦Δc≦305 | 305<Δc≦340 | 340<Δc<360 |
| 360≦Δc<395 | 395≦Δc≦405 | 405<Δc≦440 | 440<Δc<460 |
| 460≦Δc<495 | 495≦Δc≦505 | 505<Δc≦540 | 540<Δc<560 |
| 560≦Δc<595 | 595≦Δc≦605 | 605<Δc≦640 | 640<Δc<660 |
| 660≦Δc<695 | 695≦Δc≦705 | 705<Δc≦740 | 740<Δc<760 |
| 760≦Δc<795 | 795≦Δc≦805 | 805<Δc≦840 | 840<Δc<860 |
| 860≦Δc<895 | 895≦Δc≦905 | 905<Δc≦940 | 940<Δc<960 |
| 960≦Δc<995 | 995≦Δc≦1005 | 1005<Δc≦1040 | 1040<Δc<1060 |
| 1060≦Δc<1095 | 1095≦Δc≦1105 | 1105<Δc≦1140 | 1140<Δc<1160 |
| 1160≦Δc<1195 | 1195≦Δc≦1200 | | |

FIG. 6A auxiliary display table for just intonation (auxiliary display table J) unit (cent)

| ♭ indicator light-on<br># indicator light-off | ♭ indicator light-on<br># indicator light-on | ♭ indicator light-off<br># indicator light-on | ♭ indicator light-off<br># indicator light-off |
|---|---|---|---|
| | 0≦Δc≦5.0 | 5.0<Δc≦25.4 | 25.4<Δc<45.4 |
| 45.4≦Δc<65.7 | 65.7≦Δc≦75.7 | 75.7<Δc≦127.3 | 127.3<Δc<147.3 |
| 147.3≦Δc<198.9 | 198.9≦Δc≦208.9 | 208.9<Δc≦249.8 | 249.8<Δc<269.8 |
| 269.8≦Δc<310.6 | 310.6≦Δc≦320.6 | 320.6<Δc≦341.0 | 341.0<Δc<361.0 |
| 361.0≦Δc<381.3 | 381.3≦Δc≦391.3 | 391.3<Δc≦432.2 | 432.2<Δc<452.2 |
| 452.2≦Δc<493.0 | 493.0≦Δc≦503.0 | 503.0<Δc≦523.4 | 523.4<Δc<543.4 |
| 543.4≦Δc<563.7 | 563.7≦Δc≦573.7 | 573.7<Δc≦625.4 | 625.4<Δc<645.4 |
| 645.4≦Δc<697.0 | 697.0≦Δc≦707.0 | 707.0<Δc≦727.2 | 727.2<Δc<747.2 |
| 747.2≦Δc<767.4 | 767.4≦Δc≦777.4 | 777.4<Δc≦818.4 | 818.4<Δc<838.4 |
| 838.4≦Δc<879.4 | 879.4≦Δc≦889.4 | 889.4<Δc≦941.2 | 941.2<Δc<961.2 |
| 961.2≦Δc<1013.0 | 1013.0≦Δc≦1023.0 | 1023.0<Δc≦1043.0 | 1043.0<Δc<1063.0 |
| 1063.0≦Δc<1083.0 | 1083.0≦Δc≦1093.0 | 1093.0<Δc≦1134.0 | 1134.0<Δc<1154.0 |
| 1154.0≦Δc<1195.0 | 1195.0≦Δc≦1200 | | |

FIG. 6B in the case that the pitch rises (P > P b)

| N b → N | after 50ms<br>after (1×Td)ms | after 100ms<br>after (2×Td)ms | after 150ms<br>after (3×Td)ms | after 200ms<br>after (4×Td)ms |
|---|---|---|---|---|
| C → C # | C # | C # | C # | C # |
| C → D | C # | D | D | D |
| C → D # | C # | D | D # | D # |
| C → E | C # | D | D # | E |
| C → F | C # | D | E | F |
| C → F # | C # | D # | F | F # |
| C → G | C # | D # | F | G |
| C → G # | D | E | F # | G # |
| C → A | D | F | G | A |
| C → A # | D | F | G # | A # |
| C → B | D | F | G # | B |
| C → C | D # | F # | A | C |

FIG. 12A in the case that the pitch falls (P < P b)

| N b → N | after 50ms<br>after (1×Td)ms | after 100ms<br>after (2×Td)ms | after 150ms<br>after (3×Td)ms | after 200ms<br>after (4×Td)ms |
|---|---|---|---|---|
| C → B | B | B | B | B |
| C → A # | B | A # | A # | A # |
| C → A | B | A # | A | A |
| C → G # | B | A # | A | G # |
| C → G | B | A # | G # | G |
| C → F # | B | A | G | F # |
| C → F | B | A | G | F |
| C → E | A # | G # | F # | E |
| C → D # | A # | G | F | D # |
| C → D | A # | G | E | D |
| C → C # | A # | G | E | C # |
| C → C | A | F # | D # | C |

FIG. 12B

TUNING DEVICE

CROSS-REFERENCE TO RELATED APPLICATIONS

This application claims the priority benefit of Japan application serial no. 2012-253155, filed on Nov. 19, 2012. The entirety of the above-mentioned patent application is hereby incorporated by reference herein and made a part of this specification.

BACKGROUND OF THE INVENTION

1. Field of the Invention

The invention relates to a tuning device for properly tuning the harmony of two sounds that are produced simultaneously.

2. Description of Related Art

In order to achieve beautiful harmony in an ensemble, Patent Literature 1 discloses a tuner for the user to tune his pitch serving as a target pitch, which should be adopted for his instrument, corresponding to an interval of a standard music tone that has been produced. More specifically, the tuner of Patent Literature 1 performs the following events according to an interval between the scale pitch name of the input music, which is determined based on the frequency of the input music that is inputted for tuning, and a preset standard music that is harmonic with the input music: (1) determining the pitch corresponding to the scale pitch name of the standard music (pitch corresponding to the keynote of just intonation) according to an equal temperament after determining the scale pitch name of the standard music, (2) determining the reference pitch with respect to the pitch corresponding to the determined keynote of just intonation according to the just intonation with the preset interval, and displaying a pitch error of the determined reference pitch and the pitch of the input music by means of a pitch error display section.

With the tuner of Patent Literature 1, a pitch error of an input sound (input sound) with respect to a reference pitch (i.e. as a target pitch of the input sound) can be determined, wherein the input sound is one of the tones that construct harmony and the reference pitch is harmonic with the other tones (the reference sound), which are generated from the tuner and determined according to a set interval, according to the just intonation scale. Accordingly, the user can check the pitch error displayed by the pitch error display section and at the same time tune the input music to adjust the pitch error to zero.

PRIOR ART LITERATURE

Patent Literature

[Patent Literature 1] Japanese Patent Publication No. 2002-132256

SUMMARY OF THE INVENTION

Problem to be Solved

Regarding the harmony of two sounds, even though each sound may somewhat deviate from the reference pitch of the scale pitch name, the harmony can still sound beautiful (which means the two sounds have the reference interval) if the relative pitch difference of the two sounds matches the interval (referred to as "reference interval" hereinafter) between the reference pitches corresponding to the predetermined scale of the equal temperament scale, just intonation major scale, or just intonation minor scale, etc. Therefore, when two vocal performers sing at the same time for harmony practice, for example, the relative pitch difference of the two sounds can be checked to effectively carry out the tuning of each of the vocal sounds. Although the tuner of Patent Literature 1 is applicable for tuning each sound that makes up the harmony, the tuner cannot be used for checking the relative pitch difference of two sounds that are produced at the same time and thus is unsuitable for practicing harmony in vocal performance, etc.

In view of the above, the invention provides a tuning device for properly tuning the harmony of two sounds that are produced simultaneously.

Solution to the Problem and Effect of the Invention

Considering the above, a tuning device of the invention is provided with a pitch detection means, which is capable of detecting at least two pitches independently from a mixture sound of two sounds that are produced simultaneously. A pitch name that is closest to one of the pitches detected by the pitch detection means is determined as a first pitch name by a first pitch name determining means according to an equal temperament scale. A pitch name that is closest to another one (target pitch) of the pitches detected by the pitch detection means, which is different from the aforesaid one pitch, is determined as a second pitch name by a second pitch name determining means according to a predetermined scale. The tuning device of the invention includes a pitch name display means that is capable of displaying the first pitch name and the second pitch name, for the user to check the pitch name having a reference pitch that is closest to the pitches of the two sounds of the mixture sound by looking at the display of the pitch name display means. In addition, the tuning device of the invention includes a notification means that is capable of notifying the user of information about a relative difference value of a first pitch corresponding to the first pitch name and a second pitch corresponding to the second pitch name, which are among the pitches detected by the pitch detection means, so that the user can check the relative pitch difference value of the two sounds displayed by the pitch name display means through the notification of the notification means and can properly tune the two sounds that are produced simultaneously. For example, when doing harmony practice of a chorus of two parts, etc., the user can check the relative pitch difference value of the two parts through notification of the notification means and tune a relative interval (pitch difference) of the pitch of one part and the pitch of the other part, so as to achieve beautiful harmony.

In addition to the aforementioned effects, the tuning device of the invention further has the following effects. Because the second pitch name is determined by the second pitch name determining means according to a just intonation scale, which uses the first pitch name as a keynote, or the equal temperament scale, the relative interval of the two sounds that are produced simultaneously can be tuned more properly.

In addition to the aforementioned effects, the tuning device of the invention further has the following effects. (1) In the case that the second pitch name determining means determines the second pitch name according to the just intonation scale, if the relative pitch difference value exceeds a predetermined range with an interval as the center, wherein the interval is closest to the relative pitch difference value among reference intervals J according to the just intonation scale, the notification means performs a distinguishable notification notifying whether the relative pitch difference value is larger than or smaller than the aforesaid closest interval. Moreover, (2) in the case that the second pitch name determining means determines the second pitch name according to the equal temperament scale, if the relative pitch difference value of the first pitch corresponding to the first pitch name and the second pitch corresponding to the second pitch name exceeds a predetermined range with an interval as the center, wherein the interval is closest to the relative pitch difference value among reference intervals H according to the equal temperament scale, the notification means performs a distinguishable notification notifying whether the relative pitch difference value is larger than or smaller than the aforesaid closest interval. Thus, through the notification of the notification means, the user can check whether the relative pitch difference value of the two sounds is larger than or smaller than the interval, which is closest to the relative pitch difference value among the reference intervals of the just intonation scale or the equal temperament scale. Accordingly, for example, the user can produce sounds to the tuning device simultaneously and perform harmony practice by widening or narrowing the pitch difference, based on the notification of the notification means, to match the reference interval corresponding to the just intonation scale or the equal temperament scale.

In addition to the aforementioned effects, the tuning device of the invention further has the following effects. (1) In the case that the first pitch name determined by the first pitch name determining means is used as the keynote and the second pitch name determining means determines the second pitch name according to the just intonation scale, if the relative pitch difference value is in a predetermined range with an interval as the center, wherein the interval is closest to the relative pitch difference value among reference intervals J that are between a reference pitch of the keynote of the just intonation scale and a reference pitch of a random pitch name, other than the keynote of the just intonation scale, the notification means performs a predetermined notification that is different from the aforesaid distinguishable notification. Moreover, (2) in the case that the second pitch name determining means determines the second pitch name according to the equal temperament scale, if the relative pitch difference value of the first pitch corresponding to the first pitch name and the second pitch corresponding to the second pitch name is in a predetermined range with an interval as the center, wherein the interval is closest to the relative pitch difference value among reference intervals H that are between the reference pitches of two random sounds of the equal temperament scale, the notification means performs a predetermined notification that is different from the aforesaid distinguishable notification. Therefore, the user can check whether the relative pitch difference value of the two sounds is close to the reference interval of the just intonation scale or the equal temperament scale based on whether the notification means performs the predetermined notification.

BRIEF DESCRIPTION OF THE DRAWINGS

FIG. 2 is a table illustrating the relationship between the difference of the pitch of an input sound relative to the reference pitch and the luminance of each indicator of the pitch name display.

FIG. 4A is a table illustrating the cent difference of each semitone of an equal temperament scale and a major just intonation scale.

FIG. 4B is a table illustrating the reference pitch of each pitch name of the equal temperament scale and the major just intonation scale.

FIG. 4C is a table schematically illustrating the content of a pitch name determining table for equal temperament.

FIG. 5 is a table schematically illustrating the content of a pitch name determining table for just intonation (major).

FIG. 6A and FIG. 6B are tables schematically illustrating the contents of an auxiliary display table for equal temperament and an auxiliary display table for just intonation (major).

FIG. 12A and FIG. 12B are diagrams illustrating the transition display of a pitch name.

DESCRIPTION OF THE EMBODIMENTS

Figure 1B:
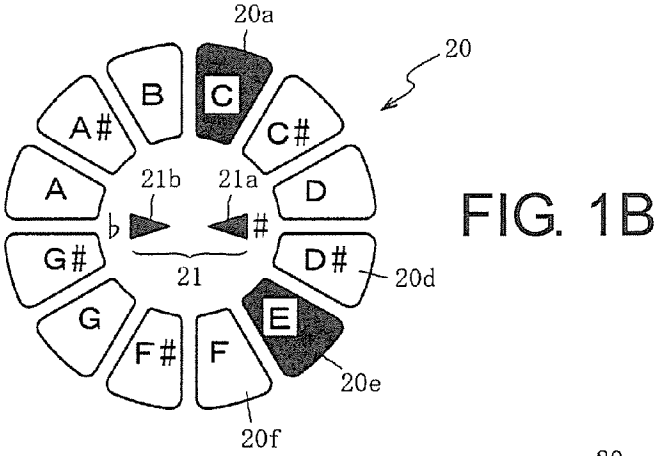
FIG. 1B to FIG. 1D are schematic diagrams illustrating the displays performed by a pitch name display and an auxiliary display.

Preferable exemplary embodiments of the invention are described in the following paragraphs with reference to the affixed figures. First, please refer to FIG. 1A to FIG. 9 for descriptions of the first embodiment of the invention. FIG. 1A is a schematic front view of a tuning device 1. The tuning device 1 is configured for tuning a sound, such as a vocal sound (voice) or an instrument sound, etc., and includes a pitch name display 20, an auxiliary display 21, a microphone 22, a loudspeaker 23, and an operation panel 15. When a mixture sound of two sounds, i.e. a vocal sound (singing) and a wind instrument sound, that are simultaneously produced is inputted via the microphone 22, the tuning device 1 detects the pitches of the two sounds that constitute the mixture sound and lights the pitch name display 20 and the auxiliary display 21 respectively based on the detected pitches. In particular, the auxiliary display 21 is configured to notify the user of the degree that a relative difference (a relative pitch difference value) of the detected pitches matches a reference interval which corresponds to an equal temperament scale or a just intonation scale. More details will be provided below. There are two types of just intonation scales, namely major and minor, with respect to the keynote, but the descriptions here are directed to the just intonation major only. Therefore, unless otherwise specified, the "just intonation scale" mentioned hereinafter all refers to a major just intonation scale.

The pitch name display 20 is configured to display a pitch name responsive to the pitch of an input sound (a sound that is to be tuned). The pitch name display 20 includes twelve indicators 20*a*-20*l* respectively corresponding to twelve pitch names (C, C♯, D, D♯, E, F, F♯, G, G♯, A, A♯, and B) that constitute an octave. In all the figures, the lowercase letter "l" is presented in cursive. The indicators 20*a*-20*l* are circumferentially arranged in a pitch order such that the pitch name (e.g. C) at one end and the pitch name (e.g. B) at the other end of the octave adjoin each other. Each of the indicators 20*a*-20*l* includes a translucent cover with a pitch name marked thereon, and an LED (light emitting diode) covered by the cover. The indicators 20*a*-20*l* are lighted by the LEDs.

The auxiliary display 21 is configured to display the deviation degree of the difference of pitches of the two tones, which are detected from the mixture sound inputted via the microphone 22, relative to the reference interval which corresponds to the equal temperament scale or the just intonation scale. The auxiliary display 21 is arranged on an inner side of the circumferentially-arranged indicators 20*a*-20*l* and includes a first indicator 21*a* and a second indicator 21*b*. The first indicator 21*a* is configured to indicate a situation that the pitch difference of the two detected sounds is larger than the reference interval, which is closest to the pitch difference, among the reference intervals corresponding to the equal temperament scale and the just intonation scale the pitch. The second indicator 21*b* is configured to indicate a situation that the pitch difference of the two detected sounds is smaller than the reference interval, which is closest to the pitch difference, among the reference intervals corresponding to the equal temperament scale and the just intonation scale the pitch. In the following descriptions, the first indicator 21*a* and the second indicator 21*b* are referred to as "♯ indicator 21*a*" and "♭ indicator 21*b*" respectively for convenience. Each of the first and second indicators 21*a* and 21*b* includes a translucent cover and an LED covered by the cover. The first and second indicators 21*a* and 21*b* are lighted by the LEDs.

Figure 1D:
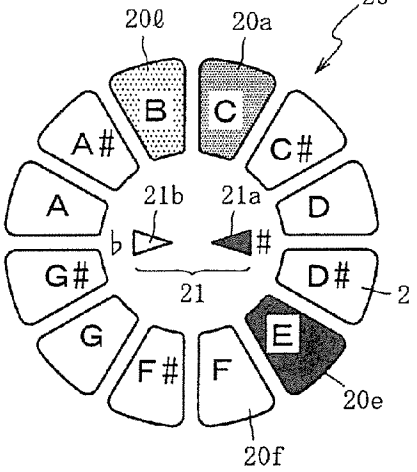
Figure 1C:
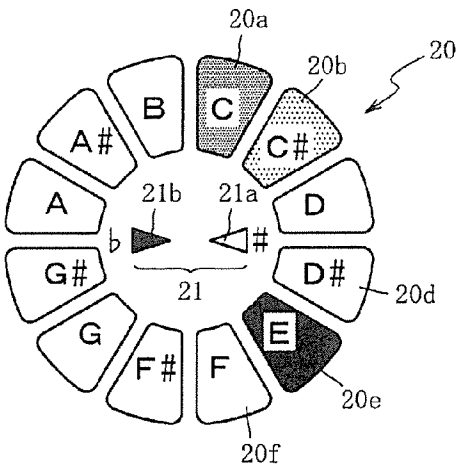
Figure 1A:
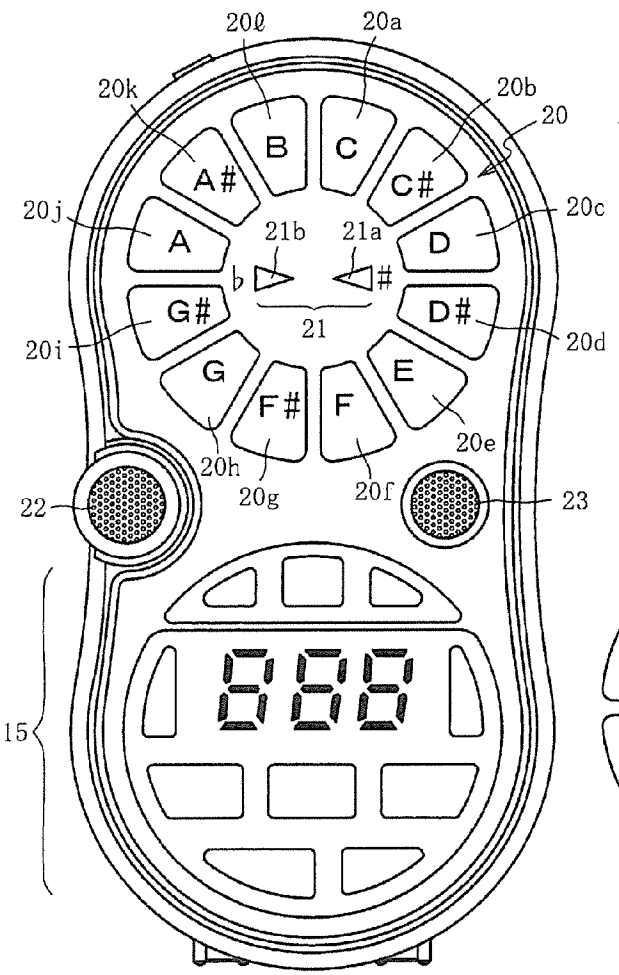
FIG. 1A is a schematic front view of a tuning device.

FIG. 1B to FIG. 1D are schematic diagrams illustrating the displays performed by the pitch name display 20 and the auxiliary display 21. FIG. 1B to FIG. 1D exemplify that the pitch name (the reference pitch name) determined responsive to the pitch of the input sound is "C".

The tuning device 1 of this exemplary embodiment is configured to light one or two adjacent indicators, among the indicators 20*a*-20*l* of the pitch name display 20, at a specific luminance responsive to the difference between the pitch of the input sound and the reference pitch of the reference pitch name when a sound is inputted. For example, when the difference between the reference pitch (reference pitch "C") of the reference pitch name "C" and the pitch of the input sound is in an in-tune state, namely, the deviation of the pitch of the input sound relative to the reference pitch "C" is small and within a tolerable range (i.e. the pitches roughly match musically), the indicator 20*a* which corresponds to the reference pitch name "C" is lighted at the maximum luminance (100%), and the adjacent indicators 20*b* and 20*l* are not lighted, as shown in FIG. 1B. By confirming that the indicator 20*a* is lighted at the maximum luminance and that the adjacent indicators 20*b* and 20*l* corresponding to the higher and lower pitch names C♯ and B are in a light-off state, the match of the pitch of the input sound and the reference pitch "C", namely successful tuning, can be visually determined. In the example of FIG. 1B to FIG. 1D, the lighted indicators of the indicators 20*a*-20*l* are hatched for illustrative purpose, and the difference in luminance is represented by different hatching (light or shade). To be more specific, darker hatching represents higher luminance and lighter hatching represents lower luminance. For instance, in FIG. 1B, the indicators 20*a* and 20*e*, ♯ indicator 21*a*, and ♭ indicator 21*b*, which are lighted at the maximum luminance, are hatched the darkest.

When the difference between the reference pitch and the pitch of the input sound increases to a certain degree, namely, the pitch of the input sound is not in the in-tune state relative to the reference pitch, one of the indicators 20*b* and 20*l* which are adjacent to the indicator 20*a* is lighted simultaneously with the indicator 20*a*, as illustrated in FIG. 1C and FIG. 1D. More specifically, in the case that the pitch of the input sound deviates to the high side relative to the reference pitch "C," the indicator 20*a* corresponding to the pitch name "C" and the indicator 20*b* corresponding to the pitch name "C♯" are lighted. In the case that the pitch of the input sound deviates to the low side relative to the reference pitch "C," the indicator 20*a* and the indicator 201 corresponding to the pitch name "B" are lighted. To explain in further detail, once the difference between the reference pitch "C" and the pitch of the input sound exceeds a predetermined threshold value, the luminance of the indicator 20*a* that corresponds to the reference pitch name gradually decreases and the luminance of the adjacent indicator 20*b* or 20*l* gradually increases as an absolute value of the difference increases, namely, the pitch of the input sound deviates from the reference pitch "C" toward the reference pitch "C♯" or "B" of the adjacent pitch name.

Moreover, when a mixture sound of two sounds that are produced simultaneously is inputted via the microphone 22, the tuning device 1 of this exemplary embodiment can display pitch names, which respectively correspond to the two sounds of the mixture sound, by means of the pitch name display 20 (the indicators 20*a*-20*l*). FIG. 1B to FIG. 1D illustrate a situation that the indicator 20*a* is lighted by one of the two sounds of the mixture sound while the indicator 20*e* is lighted by the other one. For illustrative purposes, FIG. 1B to FIG. 1D exemplify that the indicator 20*e* is lighted solely. However, as described above, if the pitch of the input sound is not in the in-tune state relative to the corresponding reference pitch, the indicator 20*e* and the adjacent indicator 20*f* or 20*d* are both lighted at the luminance corresponding to the difference. Moreover, the tuning device 1 of this exemplary embodiment has a mode for the equal temperament scale (referred to as "equal temperament mode" hereinafter) and a mode for the just intonation scale (referred to as "just intonation mode" hereinafter), which are to be used as the rhythm mode. The pitch name display 20 of the tuning device 1 can display each of the pitch names, with the deviation of the pitch name of the equal temperament scale or the just intonation scale, responsive to the rhythm mode selected by the user.

The auxiliary display 21 assists to display the deviation degree of the pitch difference of the input sound, i.e. the two sounds that are inputted as the mixture sound, relative to the reference interval that corresponds to the equal temperament scale or the just intonation scale. Details of the display performed by the auxiliary display 21 will be provided below. Through the display of the auxiliary display 21, the user can check the deviation degree of the relative pitch difference of the two sounds, which are shown by the pitch names of the pitch name display 20, relative to the reference interval that corresponds to the equal temperament scale or the just intonation scale.

Figure 3:
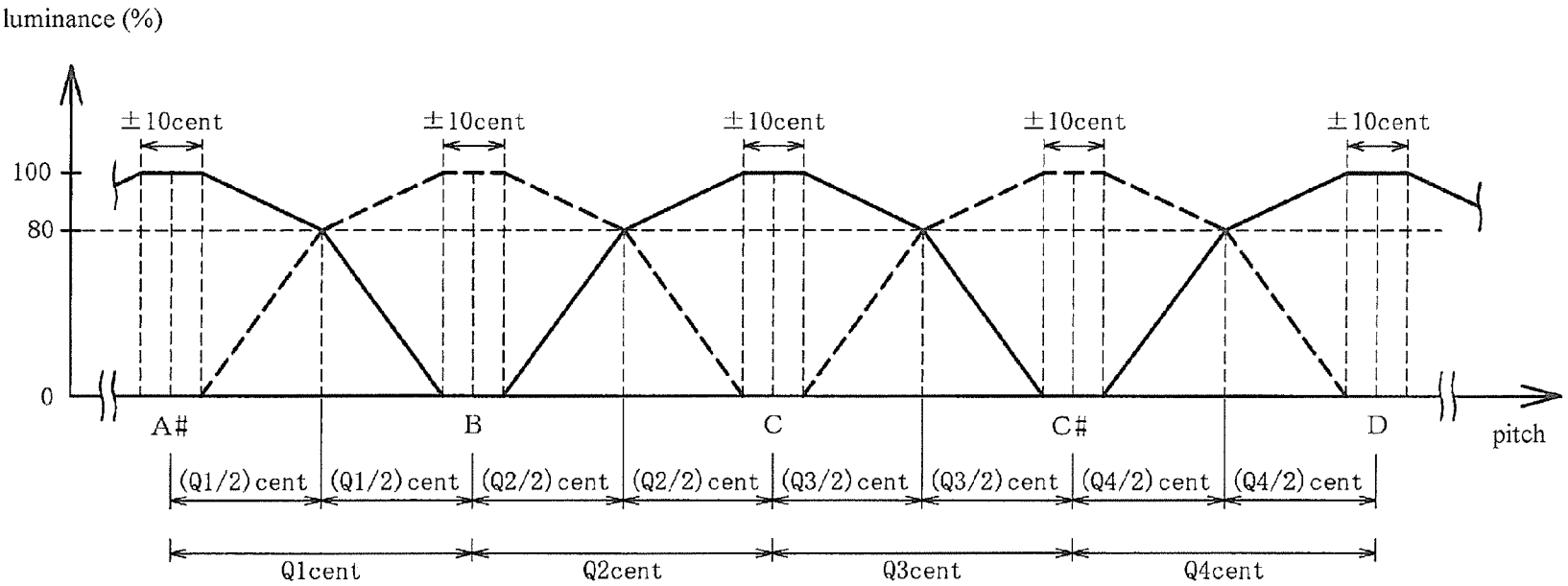
FIG. 3 is a graph illustrating the luminance variation of each indicator with respect to the pitch of the input sound.

FIG. 2 is a table illustrating the relationship between the difference of the pitch of the input sound relative to the reference pitch and the luminance of each indicator 20*a*-20*l* of the pitch name display 20 in the case that one sound (single tone) is inputted to the tuning device 1. FIG. 3 is a graph illustrating the luminance variation of each indicator 20*a*-20*l* with respect to the pitch of the input sound. With reference to the graph of FIG. 3, the horizontal axis represents the pitch and the vertical axis represents the luminance (%). In FIG. 2 or FIG. 3, the value Q1 is a cent difference between the reference pitches of the pitch names "A♯" and "B." Likewise, the values Q2, Q3, and Q4 respectively represent the cent differences between the reference pitches of the pitch names "B" and "C," "C" and "C♯," "C♯," and "D," and so on. In the case of equal temperament scale, the cent difference ( . . . , Q1, Q2, Q3, Q4, . . . ) between the reference pitches of any two adjacent pitch names of the pitch names that constitute one octave (C, C♯, D, D♯, E, F, F♯, G, G♯, A, A♯, B) is 100 cent. In the case of the just intonation scale, the cent differences between the pitches of adjacent pitch names differ from each other, and have different values even between the same two pitch names, depending on the pitch name that serves as the keynote (if the pitch name of the keynote is changed). Regarding the display foul of pitch deviation, as mentioned above, when one sound of the sound that is to be tuned is inputted and the pitch thereof is detected, one of the indicators 20*a*-20*l*, which corresponds to the reference pitch, is lighted solely, or both the indicator corresponding to the reference pitch and one adjacent indicator are lighted simultaneously, responsive to the difference of the pitch of the sound that is to be tuned relative to the reference pitch (i.e. a value obtained by subtracting the reference pitch from the pitch of the input sound). Like this exemplary embodiment, in the case that the input sound includes two sounds, the pitch deviations with respect to the two pitch names are displayed individually, like the situation of inputting only one sound, i.e. single tone. That is to say, one or two of the indicators 20*a*-20*l* are lighted responsive to the pitch differences that are respectively between the two pitches of the input sound and the two reference pitches that are closest to the two pitches.

Here the reference pitch name that is determined based on the pitch of the input sound is explained with reference to FIG. 4A to FIG. 5. Regarding pitch names sorted by semitone, the music of the scale is distinguished by ♭ (flat) and ♯ (sharp) or symbolized; however, in order to facilitate the descriptions, the following is unified as ♯ (sharp). FIG. 4A is a table illustrating the cent difference of each semitone of the equal temperament scale and the major just intonation scale. Here, the "equal temperament scale" is a practical and simplified rhythm that unifies the intervals of the twelve sounds of one octave. Therefore, for the equal temperament scale, as shown in FIG. 4A, the pitch changes by 100 cent at each semitone. In other words, the pitch difference between any two adjacent pitch names in the equal temperament scale is 100 cent. On the other hand, the "just intonation scale" is an ideal rhythm that is naturally harmonized and is a combination of sounds within one octave, wherein each sound is harmonic and has high consonance. Therefore, for the just intonation scale, as illustrated in FIG. 4A, which uses the pitch name that serves as the keynote as the reference, the pitch differences between adjacent pitch names all differ from each other.

FIG. 4B is a table illustrating the reference pitch of each pitch name of the equal temperament scale and the just intonation scale (major). Regarding the equal temperament scale, the difference per semitone between the reference pitches of the pitch names (C, C♯, D, D♯, E, F, F♯, G, G♯, A, A♯, B) of one octave is equal to 100 cents, as shown in FIG. 4A. Moreover, for the just intonation scale, the reference pitch of the pitch name that serves as the keynote is in accordance with the equal temperament scale, and the difference between the reference pitches of the pitch name that serves as the keynote and the other pitch names is equivalent to the cent difference of the "just intonation (major)" illustrated in FIG. 4A. In FIG. 4B, the reference pitch of the pitch name that serves as the keynote in each just intonation scale is surrounded by a thick frame. As shown in FIG. 4B, the reference pitch that corresponds to each pitch name of the equal temperament scale is different from that of each pitch name of the just intonation scale. Besides, in the same just intonation scale, the reference pitch of each pitch name also differs depending on the pitch name of the keynote. Accordingly, a table (pitch name determining table), which prescribes a pitch range for acquiring the reference pitch of each pitch name of the equal temperament scale and the just intonation scale respectively, is prepared beforehand for the tuning device 1 of this exemplary embodiment, so as to facilitate determining the reference pitch name of the input sound.

The pitch name determining table is explained below with reference to FIG. 4C and FIG. 5. First, FIG. 4C is a table schematically illustrating the content of the pitch name determining table for the equal temperament scale (referred to as "pitch name determining table H" hereinafter). When the rhythm mode is the equal temperament mode, the pitch name whose range covers the pitch P of the input sound is determined as the reference pitch name of the input sound by referring to the pitch name determining table H. The pitch name determining table H is also used for the just intonation mode and for determining the reference pitch name of one of the two sounds that constitute the input sound, which serves as the keynote (e.g. the sound with lower pitch). In the pitch name determining table H, a boundary value of the range of the pitch corresponding to each pitch name is a middle value of the reference pitch of the target pitch name and the reference pitch of the adjacent pitch name in the equal temperament scale.

FIG. 5 is a table schematically illustrating the content of a pitch name determining table for the just intonation scale (referred to as "pitch name determining table J" hereinafter). Each pitch name of the keynote has a pitch name determining table J. FIG. 5 only includes the pitch name determining table J for the major. When the rhythm mode is the just intonation mode, it first uses the pitch name determining table H to determine one of the two sounds of the input sound (i.e. first sound), and refers to the pitch name determining table H which uses the above sound as the keynote, and then determines the pitch name whose range is covered by the pitch P of the other sound (i.e. second sound) as the reference pitch name of the second sound. In the pitch name determining table J which is provided for each pitch name that serves as the keynote, a boundary value of the range of the pitch that corresponds to each pitch name is a middle value of the reference pitch of the target pitch name and the reference pitch of the adjacent pitch name.

Next, a lighting form (display form) of the auxiliary display 21 is described below with reference to FIG. 6A to FIG. 7B. As mentioned above, the auxiliary display 21 is used to display the deviation degree of the pitch difference of two input sounds, which are inputted as the mixture sound, relative to the reference interval that corresponds to the equal temperament scale or the just intonation scale. A table (auxiliary display table), which associates the pitch difference of the two input sounds with the lighting form of the auxiliary display 21 respectively for the equal temperament scale and the just intonation scale, is prepared beforehand for the tuning device 1 of this exemplary embodiment, so as to facilitate controlling the display of the auxiliary display 21.

Regarding the lighting form of the auxiliary display 21, in this exemplary embodiment, the tuning device 1 is directed only to the situation that the deviation degree of the pitch of the higher sound of the two input sounds relative to the lower sound that serves as the reference is displayed through the auxiliary display 21. That is to say, the tuning device 1 uses the pitch of the lower sound as the reference and displays whether the pitch difference between the reference pitch and the pitch of the higher sound deviates to a direction that is larger than the corresponding reference interval of the two sounds (the ♯ indicator 21*a* is lighted while the ♭ indicator 21*b* is not lighted) or to a direction that is smaller (the ♯ indicator 21*a* is not lighted while the ♭ indicator 21*b* is lighted). Please note that it is also possible to use the higher sound of the two input sounds as the reference and display the deviation degree of the pitch of the lower sound relative thereto. In that case, the lighting foam (light-on or light-off) of the auxiliary display 21 with respect to the pitch difference is reverse. In other words, with the pitch of the higher sound as the reference pitch, the auxiliary display 21 displays whether the pitch difference between the reference pitch and the pitch of the lower sound deviates to the direction that is larger than the corresponding reference interval of the two sounds (the ♯ indicator 21*a* is not lighted while the ♭ indicator 21*b* is lighted) or deviates to the direction that is smaller (the ♯ indicator 21*a* is lighted while the ♭ indicator 21*b* is not lighted). Details will not be repeated herein.

FIG. 6A is a table schematically illustrating the content of an auxiliary display table (referred to as "auxiliary display table H" hereinafter) for equal temperament scale. When the rhythm mode is the equal temperament mode, the ♯ indicator 21*a* and the ♭ indicator 21*b* of the auxiliary display 21 are lighted or not lighted to achieve a lighting form whose range covers a remainder Δc (in the unit of cent) that is obtained by dividing the pitch difference ΔC of the two input sounds by 1200, with reference to the auxiliary display table H.

In addition, FIG. 6B is a table schematically illustrating the content of an auxiliary display table (referred to as "auxiliary display table J" hereinafter) for the just intonation scale. The auxiliary display table J of FIG. 6B corresponds to the major just intonation scale. When the rhythm mode is the just intonation mode, the ♯ indicator 21*a* and the ♭ indicator 21*b* of the auxiliary display 21 are lighted or not lighted to achieve a lighting form whose range covers Δc (in the unit of cent), with reference to the auxiliary display table J.

As illustrated in FIG. 6A and FIG. 6B, in this exemplary embodiment, the auxiliary display 21 has four lighting forms corresponding to the value of Δc, which include: [1] a form that the ♯ indicator 21*a* and the ♭ indicator 21*b* are both lighted; [2] a form that the ♯ indicator 21*a* is lighted while the ♭ indicator 21*b* is not lighted; [3] a form that the ♯ indicator 21*a* is not lighted while the ♭ indicator 21*b* is lighted; and [4] a form that the ♯ indicator 21*a* and the ♭ indicator 21*b* are not lighted.

Figure 7A:
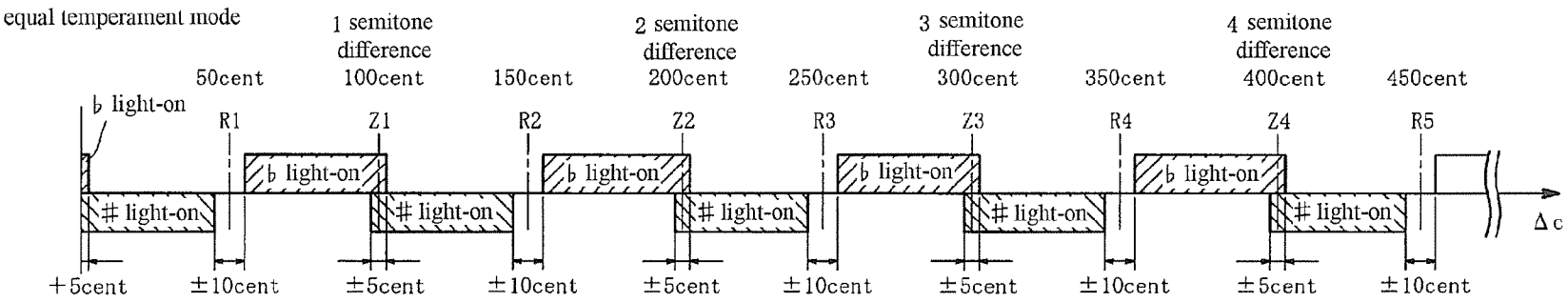
FIG. 7A and FIG. 7B are diagrams illustrating the lighting states of the auxiliary display 21 respectively in the equal temperament mode and the just intonation mode.
Figure 7B:
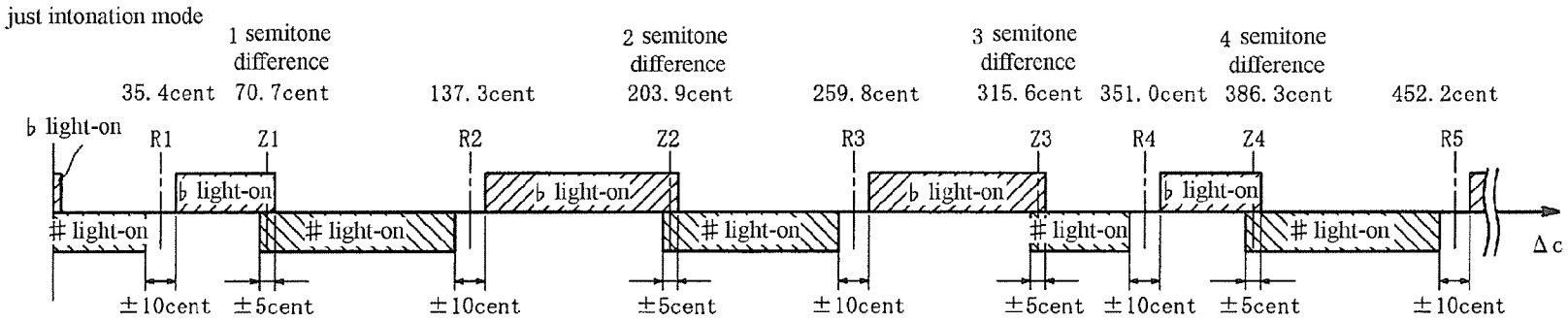

FIG. 7A is a diagram illustrating a lighting state of the auxiliary display 21 in the equal temperament mode, namely, the lighting state of the auxiliary display 21 under control based on the auxiliary display table H of FIG. 6A. FIG. 7B is a diagram illustrating a lighting state of the auxiliary display 21 in the just intonation mode, namely, the lighting state of the auxiliary display 21 under control based on the auxiliary display table J of FIG. 6B.

In FIG. 7A and FIG. 7B, the horizontal axis represents Δc, which is the remainder (in the unit of cent) that is obtained by dividing the pitch difference ΔC of the two input sounds by 1200. Moreover, in FIG. 7A and FIG. 7B, the lighting state of the ♭ indicator 21*b* corresponding to the value of Δc is shown on the upper side of the horizontal axis, and the lighting state of the ♯ indicator 21*a* corresponding to the value of Δc is shown on the lower side of the horizontal axis. To be more specific, the ranges, in which the ♯ indicator 21*a* and the ♭ indicator 21*b* are lighted, are represented by the hatched areas that are marked with "♯ lighting" and "♭ lighting" respectively. The areas that are not hatched represent the ranges, in which the ♯ indicator 21*a* or the ♭ indicator 21*b* is not lighted.

As illustrated in FIG. 7A and FIG. 7B, in either of the equal temperament mode and the just intonation mode, the ♯ indicator 21*a* and the ♭ indicator 21*b* are both lighted when the value of Δc corresponds to an X semitone difference (X is an integer equal to or larger than 0), namely, the value of Δc is in a range of ±5 cent with the reference interval (Z1, Z2, Z3, Z4 . . . ) as the center. The lighting of both of the ♯ indicator 21*a* and the ♭ indicator 21*b* indicates that the relative pitch difference of the two sounds, which constitute the mixture sound inputted via the microphone 22, falls within the predetermined pitch range (±5 cent) of the reference interval, which is closest to the relative pitch difference, among the reference intervals of the equal temperament scale or the just intonation scale. In other words, the inputted two sounds harmonically match each other.

Moreover, neither of the ♯ indicator 21*a* and the ♭ indicator 21*b* is lighted when the value of Δc is in a range of ±10 cent with a value (R1, R2, R3, R4, R5 . . . ) that corresponds to a middle of the X semitone difference and a (X+1) semitone difference as the center. Therefore, when the ♯ indicator 21*a* and the ♭ indicator 21*b* are not lighted, it indicates that the relative pitch difference of the two sounds, which constitute the mixture sound inputted via the microphone 22, deviates far from the reference interval of the equal temperament scale or the just intonation scale.

In addition, in the case that the value of Δc is not in the range of ±5 cent with the X semitone difference as the center, nor in the range of ±10 cent with the value that corresponds to the middle of the X semitone difference and the (X+1) semitone difference as the center, the ♯ indicator 21*a* is lighted and the ♭ indicator 21*b* is not lighted when the value of Δc is larger than a value, which is closest to the value of Δc, among the values (Z1, Z2, Z3, Z4 . . . ) corresponding to the X semitone difference that serves as the reference interval. The above indicates that the relative pitch difference of the two sounds that constitute the mixture sound inputted via the microphone 22 is larger than the reference interval, which is closest to the pitch difference, among the reference intervals of the equal temperament scale or the just intonation scale.

In the case that the value of Δc is not in the range of ±5 cent with the X semitone difference as the center, nor in the range of ±10 cent with the value that corresponds to the middle of the X semitone difference and the (X+1) semitone difference as the center, the ♭ indicator 21*b* is lighted and the ♯ indicator 21*a* is not lighted when the value of Δc is smaller than the value, which is closest to the value of Δc, among the values (Z1, Z2, Z3, Z4 . . . ) corresponding to the X semitone difference. If the ♭ indicator 21*b* is lighted solely, it indicates that the relative pitch difference of the two sounds that constitute the mixture sound inputted via the microphone 22 is smaller than the reference interval, which is closest to the pitch difference, among the reference intervals of the equal temperament scale or the just intonation scale.

According to the above descriptions, the auxiliary display 21 of the tuning device 1 of this exemplary embodiment is lighted in a lighting form responsive to the relative pitch difference of the two sounds that constitute the mixture sound inputted via the microphone 22. For example, when doing harmony practice of a chorus of two parts, two singers may check the lighting form of the auxiliary display 21 to tune the pitches of the vocal sounds (input sounds) of each other, so as to match the pitch difference of the two sounds with the reference interval of the equal temperament scale or the just intonation scale, namely, to light both of the ♯ indicator 21*a* and the ♭ indicator 21*b*. If only the ♯ indicator 21*a* is lighted, for example, the two singers tune the pitch of one or both of the vocal sounds to reduce the pitch difference of the two sounds. On the other hand, if only the ♭ indicator 21*b* is lighted, for example, the two singers tune the pitch of one or both of the vocal sounds to increase the pitch difference of the two sounds. Accordingly, through tuning the input sounds to match the pitch difference of the two sounds with the reference interval of the equal temperament scale or the just intonation scale, the relative pitch difference of the two singers can be matched with the interval to achieve beautiful harmony.

In the case that the input sounds include two sounds, the tuning device 1 of this exemplary embodiment is applicable to display pitch deviations independently for the respective pitch names, just like the situation when only one sound, i.e. single sound, is inputted. Therefore, information about whether the respective pitches of the sounds of the two singers match the reference pitches of the corresponding pitch names or deviate toward the high or low direction can be obtained visually by looking at the pitch name display 20. Accordingly, the two singers can refer to the pitch name display 20 to check the deviation degrees of the pitches of the sounds they produce relative to the reference pitches of the pitch names corresponding thereto, and learn the accuracy of the relative intervals of the pitches of each other (namely, whether they match the reference intervals) through the aforementioned auxiliary display 21, and therefore can perform harmony practice of a chorus of two parts effectively.

Figure 8A:
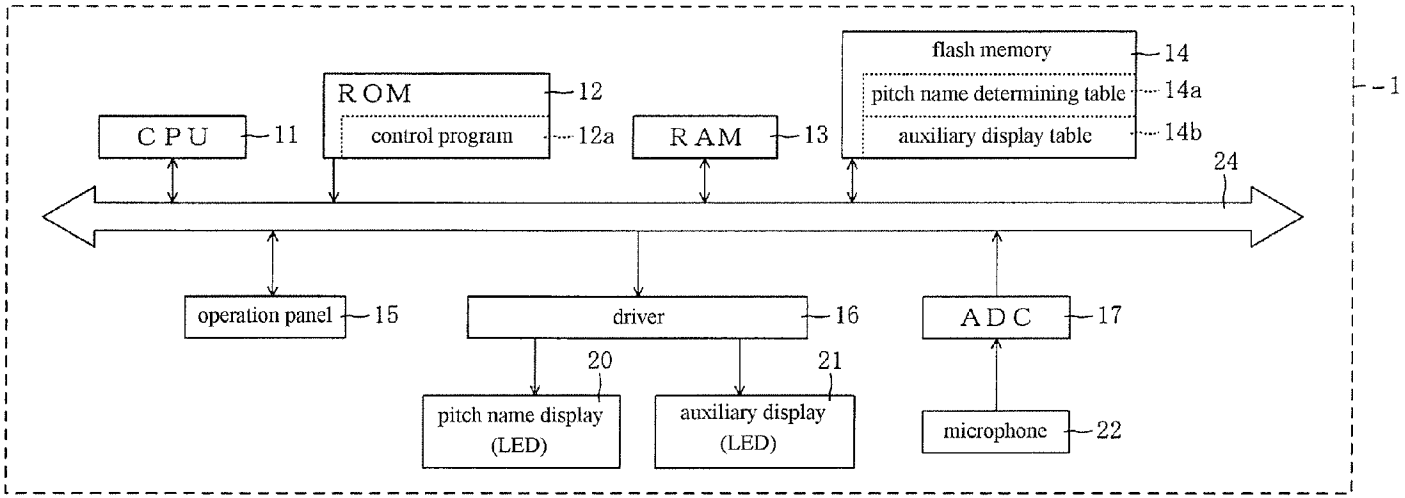
FIG. 8A is a block diagram illustrating an electrical structure of the tuning device.

FIG. 8A is a block diagram illustrating an electrical structure of the tuning device 1. The tuning device 1 includes a CPU 11, a ROM 12, a RAM 13, a flash memory 14, the operation panel 15, a driver 16, an analog-to-digital converter (ADC) 17, the pitch name display 20, the auxiliary display 21, and the microphone 22. The components 11-17 are connected with each other via a bus line 24. The microphone 22 is connected to the ADC 17. The pitch name display 20 and the auxiliary display 21 are connected to the driver 16.

Figure 9:
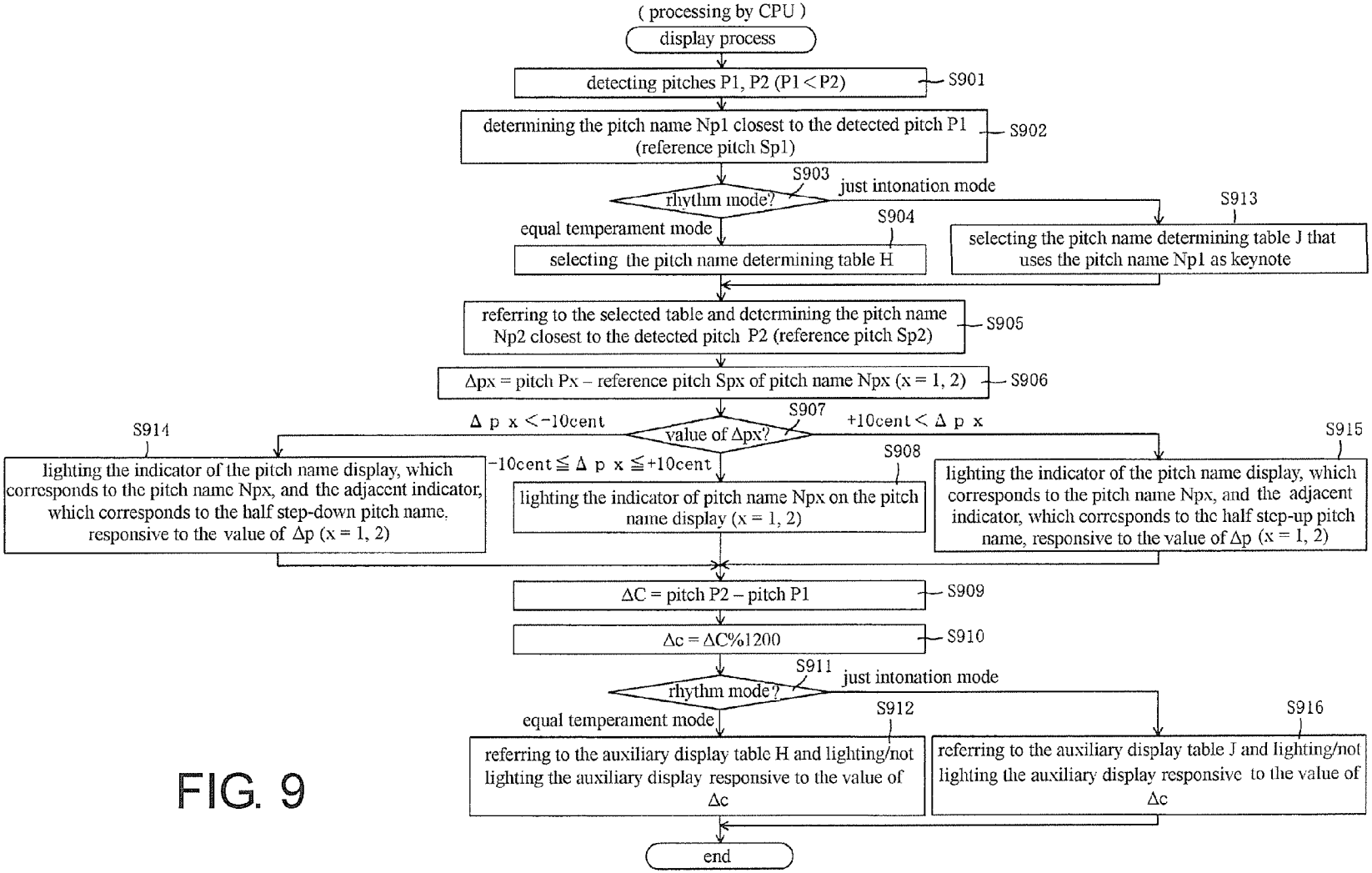
FIG. 9 is a flowchart illustrating the display process.

The CPU 11 is a central control device that controls each component of the tuning device 1 according to fixed values or programs stored in the ROM 12 and data stored in the RAM 13, etc. The CPU 11 includes a timer (not shown in the figure) therein for measuring time by counting a clock signal. The ROM 12 is an unrewritable non-volatile memory that stores a control program 12*a* executed by the CPU 11 and fixed value data (not shown in the figure) referred by the CPU 11 when the control program 12*a* is executed, etc. In addition, the processes in the flowchart of FIG. 9 are executed on the basis of the control program 12*a*.

The RAM 13 is a rewritable volatile memory that has a temporary area for temporarily storing various data upon the execution of the control program 12*a* performed by the CPU 11. The flash memory 14 is a rewritable non-volatile memory which stores a pitch name determining table 14*a* and an auxiliary display table 14*b*.

The pitch name determining table 14*a* prescribes pitch ranges that correspond to the sounds of one octave, and records a pitch name determining table H to be used for the equal temperament mode and a pitch name determining table J to be used for the just intonation mode. The pitch name determining table H is the table of the aforementioned FIG. 4C. In the tuning device 1 of this exemplary embodiment, the table that is prescribed corresponding to the reference pitches of the major just intonation scale, namely, the pitch name determining table J of FIG. 5, is stored as the pitch name determining table for just intonation.

The auxiliary display table 14*b* is a table that associates the pitch difference of the two input sounds with the lighting form of the auxiliary display 21, and records the auxiliary display table H of FIG. 6A used for the equal temperament mode and the auxiliary display table J of FIG. 6B used for the just intonation mode.

The operation panel 15 is a panel provided with an operator for the user to input various instructions and indicators composed of 7-segment LEDs, etc. The operation panel 15 includes a mode selection operator 37 (see FIG. 8B) for setting the rhythm mode to the equal temperament mode or the just intonation mode.

The driver 16 is an LED driver that is connected to the LEDs respectively provided to the indicators 20*a*-20*l* of the pitch name display 20 and the LEDs respectively provided to the indicators 21*a* and 21*b* of the auxiliary display 21 for lighting the LEDs. The driver 16 lights the LED of the indicated target in accordance with the control information, which indicates the lighting form, inputted from the CPU 11. The driver 16 controls the luminance of each LED by pulse width modulation (PWM) control. Therefore, if the control information provided from the CPU 11 is information that designates the luminance of the LED, a power pulse with a duty ratio corresponding to the designated luminance is supplied to the control target, i.e. the LED. Accordingly, the LEDs respectively provided to the indicators 20*a*-20*l* and the indicators 21*a* and 21*b* are lighted at the luminance corresponding to the duty ratio of the supplied power pulse, namely, the luminance designated by the CPU 11. In this exemplary embodiment, the LEDs of the indicators 20*a*-20*l* are multi-color LEDs (three-color LEDs in this exemplary embodiment) that emit lights of colors responsive to the control information of the CPU 11.

Figure 8B:
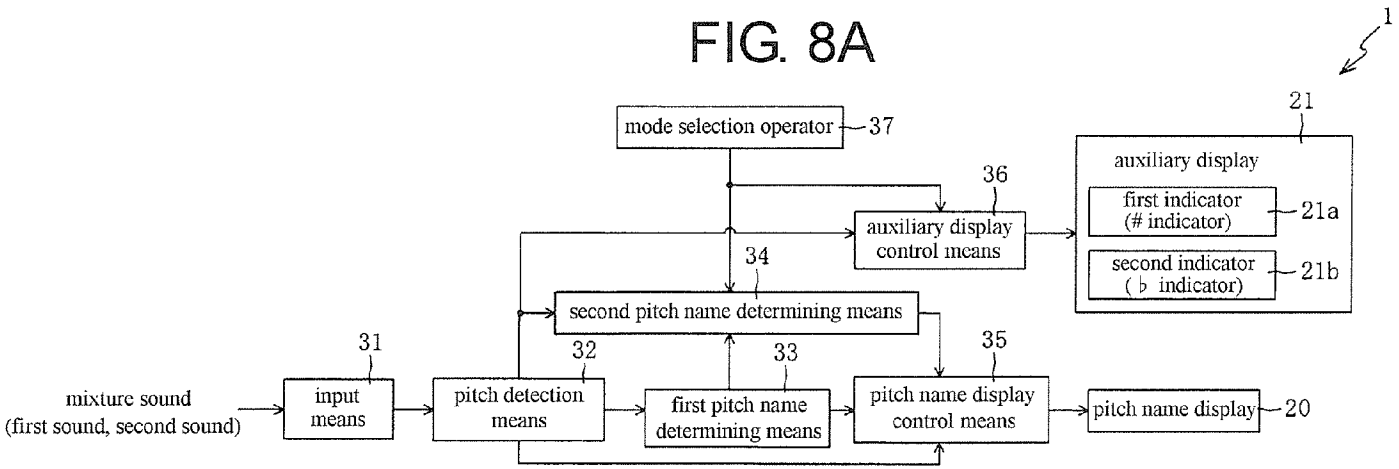
FIG. 8B is a functional block diagram illustrating functions of the tuning device.

FIG. 8B is a functional block diagram illustrating functions of the tuning device 1. As illustrated in FIG. 8B, the tuning device 1 includes an input means 31, a pitch detection means 32, a first pitch name determining means 33, a second pitch name determining means 34, a pitch name display control means 35, an auxiliary display output means 36, the mode selection operator 37, the pitch name display 20, and the auxiliary display 21.

The mode selection operator 37 is one of the operators installed on the operation panel 15 and is operated by the user for the user to select the rhythm mode. More specifically, the rhythm mode can be set to the equal temperament mode or the just intonation mode by operating the mode selection operator 37. When the user operates the mode selection operator 37 to select one of the equal temperament mode and the just intonation mode as the rhythm mode, information indicating the selected mode is provided to the second pitch name determining means 34 and the auxiliary display control means 36.

The input means 31 has a function of inputting the input sound from the outside into the tuning device 1, and is implemented by the microphone 22 and the ADC 17, etc. The input means 31 provides the input sound to the pitch detection means 32. In this exemplary embodiment, the mixture sound of two sounds (a first sound and a second sound) that are produced simultaneously is inputted via the input means 31, and in such a case, the mixture sound is provided to the pitch detection means 32.

The pitch detection means 32 has a function of detecting the pitch of the input sound provided from the input means 31 and is implemented by the CPU 11, etc. The pitch detection means 32 of this exemplary embodiment is capable of detecting the pitches of two sounds independently. Therefore, when the mixture sound that includes the first sound and the second sound is inputted to the input means 31, the pitch detection means 32 detects the pitch of the first sound and the pitch of the second sound respectively. Since the method of detecting multiple pitches independently (pitches of two sounds, for example) is commonly known, details will not be described hereinafter. The pitch detection means 32 provides the pitch of the first sound, among the detected pitches, to the first pitch name determining means 33 and provides the pitch of the second sound to the second pitch name determining means 34. In addition, the pitch detection means 32 provides the detected pitches of the two sounds to the pitch name display control means 35 and the auxiliary display control means 36.

The first pitch name determining means 33 has a function of determining the reference pitch name of the first sound that is contained in the mixture sound inputted from the input means 31, which is implemented by the CPU 11, etc. The first pitch name determining means 33 determines the reference pitch name of the first sound based on the pitch of the first sound, which is provided from the pitch detection means 32. More specifically, the first pitch name determining means 33 selects the pitch name that is closest to the pitch of the first sound as the reference pitch name. In this exemplary embodiment, the pitch name determining table H, as one of the pitch name determining table 14*a*, is referred to for determining the pitch name that corresponds to the range covering the pitch of the first sound as the reference pitch name of the first sound. The first pitch name determining means 33 provides the determined reference pitch name of the first sound to the second pitch name determining means 34 and the pitch name display control means 35.

The second pitch name determining means 34 has a function of determining the reference pitch name of the second sound that is contained in the mixture sound inputted from the input means 31, which is implemented by the CPU 11, etc. The second pitch name determining means 34 determines the reference pitch name of the second sound and the reference pitch based on the pitch of the second sound, which is provided from the pitch detection means 32. The second pitch name determining means 34 determines the reference pitch name of the second sound according to the rhythm that corresponds to the mode selected by means of the mode selection operator 37. More specifically, when the equal temperament mode is selected, the pitch name that is closest to the pitch of the second sound is determined as the reference pitch name on the basis of the equal temperament scale. According to this exemplary embodiment, in the case of the equal temperament mode, the pitch name determining table H, as one of the pitch name determining table 14*a*, is referred to for determining the pitch name that corresponds to the range covering the pitch of the second sound as the reference pitch name of the second sound.

However, when the just intonation mode is selected, the pitch name that is closest to the pitch of the second sound is determined as the reference pitch name based on the just intonation scale, which uses the pitch name of the first sound provided from the first pitch name determining means 33 as the keynote. According to this exemplary embodiment, in the case of the just intonation mode, the table which uses the pitch name of the first sound provided from the first pitch name determining means as the keynote, among the pitch name determining table J, namely, one of the pitch name determining table 14*a*, is referred to for determining the pitch name that corresponds to the range covering the pitch of the second sound as the reference pitch name of the second sound. The second pitch name determining means 34 provides the determined reference pitch name of the second sound to the pitch name display control means 35.

The pitch name display control means 35 has a function of controlling the lighting of the pitch name display 20, and is implemented by the CPU 11 and the driver 16, etc. The pitch name display control means 35 supplies the power pulse with the duty ratio corresponding to the lighting luminance to the indicators, which are lighting targets among the indicators 20*a*-20*l* of the pitch name display 20, according to the pitch of the first sound provided from the pitch detection means 32, the reference pitch name of the first sound provided from the first pitch name determining means 33, and the reference pitch corresponding to the reference pitch name. When the pitch name display control means 35 supplies the power pulse, the LEDs of the indicators 20*a*-20*l*, which are the lighting targets, with respect to the pitch name display control means 35 are lighted with predetermined light colors and luminances, so as to display the pitch name corresponding to the first sound of the inputted mixture sound on the pitch name display 20.

Furthermore, the pitch name display control means 35 supplies the power pulse with the duty ratio corresponding to the lighting luminance to the indicators, which are lighting targets among the indicators 20*a*-20*l* of the pitch name display 20, according to the pitch of the second sound provided from the pitch detection means 32, the reference pitch name of the second sound provided from the second pitch name determining means 34, and the reference pitch corresponding to the reference pitch name, so as to display the pitch name corresponding to the second sound of the inputted mixture sound on the pitch name display 20.

The auxiliary display control means 36 has a function of controlling the lighting of the auxiliary display 21 (the first indicator 21*a* and the second indicator 21*b*) and is implemented by the CPU 11 and the driver 16, etc. The auxiliary display control means 36 supplies the power pulse with the duty ratio corresponding to the lighting luminance to the indicator, which is the lighting target among the indicators 21*a* and 21*b* of the auxiliary display 21, according to the pitch difference of the pitches of the first sound and the second sound provided from the pitch detection means 32. When the auxiliary display control means 36 supplies the power pulse, the LED of the indicator 21*a* and/or 21*b*, which is the lighting target, with respect to the auxiliary display control means 36 is lighted with a predetermined light color and luminance.

The auxiliary display control means 36 determines the indicator 21*a*, 21*b* as the lighting target in accordance with the rhythm that corresponds to the mode selected by means of the mode selection operator 37. To be more specific, when the equal temperament mode is selected, the auxiliary display table H, as one of the auxiliary display table 14*b*, is referred to for determining the indicator 21*a*, 21*b* as the lighting target according to the pitch difference of the pitches of the first sound and the second sound. On the other hand, when the just intonation mode is selected, the auxiliary display table J, as one of the auxiliary display table 14*b*, is referred to for determining the indicator 21*a*, 21*b* as the lighting target according to the pitch difference of the pitches of the first sound and the second sound.

FIG. 9 is a flowchart illustrating the display process performed by the CPU 11 of the tuning device 1 having the aforementioned structure. The display process is a process for controlling the display performed by the pitch name display 20 and the auxiliary display 21 on the basis of the pitches detected from the mixture sound (the input sound) inputted via the microphone 22. The display process is initiated upon input of the instruction of starting the tuning process for the mixture sound and is executed repeatedly at predetermined time intervals (for example, per 200 ms) thereafter by predetermined operations to the operation panel 15.

First, the CPU 11 detects pitches P1 and P2 (P1<P2) of the two sounds that are contained in the mixture sound respectively (S901). The pitch P1 refers to the pitch of the first sound and the pitch P2 refers to the pitch of the second sound. Next, the CPU 11 determines a pitch name Np1, which is closest to the detected pitch P1, and a reference pitch Sp1, which corresponds to the pitch name Np1 (S902), and moves on to S903. In S902, the CPU 11 refers to the pitch name determining table H of FIG. 4C, which is stored as the pitch name determining table 14*a,* and determines the pitch name that corresponds to the range covering the pitch P1 as the pitch name Np1. Moreover, the reference pitch Sp1 that corresponds to the pitch name Np1 is determined according to the equal temperament.

In S903, the CPU 11 determines the rhythm mode. If the CPU 11 determines that the rhythm mode is the equal temperament mode (S903: equal temperament mode), the CPU 11 selects the pitch name determining table H to be the table for determining the pitch name of the second sound (S904), and moves on to S905. If the CPU 11 determines that the rhythm mode is the just intonation mode (S903: just intonation mode), the CPU 11 selects the table, which uses the pitch name Np1 as the keynote, among the pitch name determining table J of FIG. 5 that is stored as the pitch name determining table 14*a,* to be the table for determining the pitch name of the second sound (S913), and moves on to S905.

In S905, the CPU 11 refers to the table selected in S904 or S913 and determines a pitch name Np2, which is closest to the detected pitch P2, and a reference pitch Sp2, which corresponds to the pitch name Np2. In S905, the reference pitch Sp2 that corresponds to the pitch name Np2 is determined according to the equal temperament scale when in the equal temperament mode and determined according to the just intonation scale, which uses the pitch name Np1 as the keynote, when in the just intonation mode.

Then, given that x=1 and x=2, the CPU 11 respectively calculates a difference Δpx by subtracting a reference pitch Spx of the pitch name Npx from a detected pitch Px in the unit of cent (S906). That is to say, in S906, the CPU 11 calculates the deviation degree of the detected pitch relative to the reference pitch of the determined pitch name in the unit of cent respectively for the first sound and the second sound.

Thereafter, the CPU 11 judges the value of Δpx that is obtained respectively when x−1 and x−2 (S907). In S907, if the CPU 11 determines that the value of Δpx is in the range of −10 cent≤Δpx≤+10 cent (S907: −10 cent≤Δpx≤+10 cent), the CPU 11 outputs control information to the driver 16 to make the indicator of the pitch name display 20, which corresponds to the pitch name Npx, emit red light at the luminance of 100% (S908), and moves on to S909. Therefore, when the value of Δpx is in the range of −10 cent≤Δpx≤+10 cent, the indicator of the indicators 20*a*-20*l*, which corresponds to the pitch name Npx, emits red light at the luminance of 100%.

In S907, if the CPU 11 determines that the value of Δpx satisfies Δpx<−10 cent (S907: Δpx<−10 cent), the CPU 11 outputs control information to the driver 16 to make the indicator of the pitch name display 20, which corresponds to the pitch name Npx, and the adjacent indicator, which corresponds to the half step-down pitch, emit red light at the luminance responsive to the value of Δpx (S914), and moves on to S909. In S914, for example, the luminances of the two indicators are determined in accordance with the relationship illustrated by the graph of FIG. 3. Accordingly, in the case that the value of Δpx is smaller than −10 cent, the indicator, which corresponds to the pitch name Npx, and the adjacent indicator, which corresponds to the half step-down pitch, among the indicators 20*a*-20*l* both emit red light. In addition thereto, the luminance of the indicator corresponding to the pitch name Npx gradually decreases as the absolute value of Δpx increases, and the luminance of the adjacent indicator that corresponds to the half step-down pitch increases as the absolute value of Δpx increases.

Moreover, in S907, if the CPU 11 determines that the value of Δpx satisfies +10 cent<Δpx (S907: +10 cent<Δpx), the CPU 11 outputs control information to the driver 16 to make the indicator of the pitch name display 20, which corresponds to the pitch name Npx, and the adjacent indicator, which corresponds to the half step-up pitch, emit red light at the luminance responsive to the value of Δpx (S915), and moves on to S909. In S915, for example, the luminances of the two indicators are determined in accordance with the relationship illustrated by the graph of FIG. 3. Accordingly, in the case that the value of Δpx is larger than +10 cent, the indicator, which corresponds to the pitch name Npx, and the adjacent indicator, which corresponds to the half step-up pitch, among the indicators 20*a*-20*l* both emit red light. In addition thereto, the luminance of the indicator corresponding to the pitch name Npx gradually decreases as the absolute value of Δpx increases, and the luminance of the adjacent indicator that corresponds to the half step-up pitch increases as the absolute value of Δpx increases.

According to this exemplary embodiment, the pitch name display 20 (indicators 20*a*-20*l*) emits red light in both the situations of x=1 (first sound) and x=2 (second sound). However, the pitch name display 20 may also be configured to emit lights of different colors for the situations of x=1 and x=2. For example, red light may be emitted for the situation of x=1, and blue light may be emitted for the situation of x=2.

In S909, the CPU 11 calculates a difference ΔC in the unit of cent by subtracting the pitch P1 from the pitch P2. That is, in S909, the CPU 11 calculates the relative difference ΔC of the pitch P1 of the first sound and the pitch P2 of the second sound in the unit of cent. Following that, the CPU 11 calculates ΔC%1200 to obtain Δc (S910). The operator "%" is a remainder operator. In other words, in S910, the CPU 11 calculates a remainder, which serves as Δc, by dividing ΔC by 1200.

Then, the CPU 11 determines the rhythm mode (S911). If the CPU 11 determines that the rhythm mode is the equal temperament mode (S911: equal temperament mode), the CPU 11 refers to the auxiliary display table H of FIG. 6A that is stored as the auxiliary display table 14*b* and outputs control information to the driver 16 to make the LED of the auxiliary display 21 (♯ indicator 21*a* and ♭ indicator 21*b*) emit light in a lighting form responsive to the value of Δc or not emit light (S912), and ends the process.

In S911, if the CPU 11 determines that the rhythm mode is the just intonation mode (S911: just intonation mode), the CPU 11 refers to the pitch name determining table J of FIG. 6B that is stored as the auxiliary display table 14*b* and outputs control information to the driver 16 to make the LED of the auxiliary display 21 (♯ indicator 21*a* and ♭ indicator 21*b*) emit light in a lighting form responsive to the value of Δc or not emit light (S916), and ends the process.

When the processes of S912 and S916 are carried out, the auxiliary display 21 (the ♯ indicator 21*a* and the ♭ indicator 21*b*) is lighted in a lighting form responsive to the value of Δc or not lighted. More specifically, if the value of Δc is in the range of ±5 cent with the value that corresponds to the X semitone difference (X is an integer equal to or larger than 0) of the equal temperament scale or the just intonation scale as the center, both of the ♯ indicator 21*a* and the ♭ indicator 21*b* are lighted. If the value of Δc is in the range of ±10 cent with the value that corresponds to the middle of the X semitone difference and the (X+1) semitone difference as the center, neither of the ♯ indicator 21*a* and the ♭ indicator 21*b* is lighted.

Moreover, in the case that the value of Δc is not in the range of ±5 cent with the X semitone difference as the center, nor in the range of ±10 cent with the value that corresponds to the middle of the X semitone difference and the (X+1) semitone difference as the center, the ♯ indicator 21*a* is lighted and the ♭ indicator 21*b* is not lighted when the value of Δc is larger than a value, which is closest to the value of Δc, among the values corresponding to the X semitone difference. In the case that the value of Δc is not in the range of ±5 cent with the X semitone difference as the center, nor in the range of ±10 cent with the value that corresponds to the middle of the X semitone difference and the (X+1) semitone difference as the center, the ♭ indicator 21*b* is lighted and the ♯ indicator 21*a* is not lighted when the value of Δc is smaller than the value, which is closest to the value of Δc, among the values corresponding to the X semitone difference.

According to the above, the tuning device 1 of this exemplary embodiment controls the lighting form (display form) of the auxiliary display 21 responsive to the relative pitch difference of the two sounds that constitute the mixture sound. Therefore, the user can check whether the pitches of the two sounds match the reference pitch of the corresponding pitch name or whether the pitches deviate to the higher side or the lower side by means of the pitch name display 20, and at the same time, the user can confirm the relative pitch difference of the two sounds through the lighting form of the auxiliary display 21. When doing harmony practice of a chorus of two parts, etc., for instance, the user can check the relative pitch difference of the sounds of the respective parts through the lighting form of the auxiliary display 21 to tune the relative interval (pitch difference) of the pitches of one part and the other part, instead of the absolute interval of each part, so as to achieve beautiful harmony. In this way, the user can practice harmony performance to make the two sounds into harmonic sounds that have an interval of major third or perfect fifth. The mixture sound, namely the tuning target, may be a mixture of two sounds that are simultaneously produced by sound sources, e.g. vocal sounds of two persons or sounds of two wind instruments, outside the tuning device 1, or may be a mixture of a sound produced by the tuning device 1 and a vocal sound or wind instrument sound in the case that the tuning device 1 has a loudspeaker for producing sounds based on musical data.

Considering that the pitch names corresponding to the pitches of the two sounds are displayed simultaneously and the interval thereof varies constantly (for example, the two sounds include a part 1 and a part 2, and the pitch names NP1 and NP2 of the pitch name display 20 respectively corresponding to the pitches of the two parts are lighted with the same color and the same luminance), once the pitches of the part 1 and the part 2 vary, it would be difficult to know which of the two pitch names that are lighted corresponding to the new pitches is NP1 and which is NP2. Therefore, in some way, showing a transition state (a track of pitch variation) of the respective pitches of the part 1 and part 2 on the pitch name display 20 is desirable.

Below the second exemplary embodiment of the invention is explained with reference to FIG. 10 to FIG. 12B. The tuning device 1 of this exemplary embodiment is configured to display the form of pitch variation, namely the transition state of the pitch, by the pitch name display 20 when the pitch of the input sound varies, such that the user can easily understand the variation of the pitch by visually. In this exemplary embodiment, components that are the same as those of the first exemplary embodiment are assigned with identical reference numerals, and descriptions thereof will not be repeated hereinafter.

Figure 10:
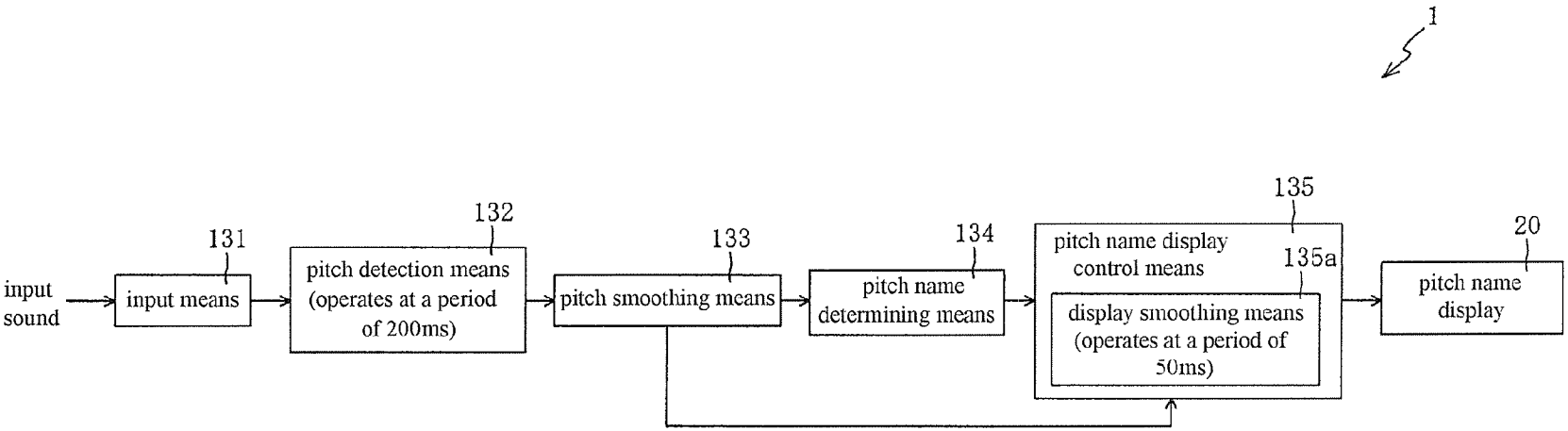
FIG. 10 is a functional block diagram illustrating functions of a tuning device of the second exemplary embodiment.

FIG. 10 is a functional block diagram illustrating functions of the tuning device 1 of the second exemplary embodiment. The tuning device 1 of the second exemplary embodiment has the same configuration as shown in FIG. 1 and FIG. 8A. According to FIG. 10, the tuning device 1 of the second exemplary embodiment includes an input means 131, a pitch detection means 132, a pitch smoothing means 133, a pitch name determining means 134, a pitch name display control means 135, and the pitch name display 20.

The input means 131 has a function of inputting the input sound from the outside into the tuning device 1, and is implemented by the microphone 22 and the ADC 17, etc. The input means 131 provides the input sound to the pitch detection means 132. The pitch detection means 132 has a function of detecting the pitch of the input sound provided from the input means 131 and is implemented by the CPU 11, etc. In this exemplary embodiment, the pitch detection means 132 is configured to perform pitch detection every 200 ms. Moreover, the pitch detection means 132 provides the detected pitch p to the pitch smoothing means 133.

The pitch smoothing means 133 has a function of preventing pitch swing, which occurs near the reference pitch of the reference pitch name, and is implemented by the CPU 11, etc. The pitch smoothing means 133 determines whether the reference pitch name, which is determined according to the pitch p detected by the pitch detection means 132, is the same as the previously determined reference pitch name. If the reference pitch name is different from the previously determined reference pitch name, the detected pitch p is determined as the pitch P for determining the reference pitch name. On the contrary, if the reference pitch name determined according to the pitch p detected by the pitch detection means 132 is the same as the previously determined reference pitch name, an average value of the pitches of the past X times (10 times in this exemplary embodiment), which includes the pitch p that is detected this time, is determined as the pitch P for determining the reference pitch name. The pitch smoothing means 133 provides the determined pitch P to the pitch name determining means 134 and the pitch name display control means 135.

The pitch name determining means 134 has a function of determining the reference pitch name of the input sound inputted from the input means 131 and is implemented by the CPU 11, etc. The pitch name determining means 134 determines the reference pitch name of the input sound based on the pitch P which is provided from the pitch smoothing means 133. More specifically, the pitch name that is closest to the pitch P is determined to be the reference pitch name. In this exemplary embodiment, the pitch name determining means 134 determines the reference pitch name in accordance with the equal temperament scale. Moreover, the pitch name determining means 134 provides the determined reference pitch name to the pitch name display control means 135.

The same as the pitch name display control means 35 of the first exemplary embodiment, the pitch name display control means 135 has a function of controlling the lighting of the pitch name display 20 and is implemented by the CPU 11 and the driver 16, etc. The pitch name display control means 135 supplies the power pulse with the duty ratio corresponding to the lighting luminance to the indicators, which are lighting targets among the indicators 20*a*-20*l* of the pitch name display 20, according to the pitch P provided from the pitch smoothing means 133, the reference pitch name provided from the pitch name determining means 134, and the reference pitch corresponding to the reference pitch name, thereby displaying the pitch name corresponding to the input sound on the pitch name display 20.

The pitch name display control means 135 includes a display smoothing means 135*a*. The display smoothing means 135*a* has a function of displaying the form of pitch variation on the pitch name display 20 when the pitch of the input sound varies for the user to easily understand the pitch variation visually, and is implemented by the CPU 11, etc. In the case that a reference pitch name N determined by the pitch name determining means 134 is different from a previous reference pitch name Nb, the display smoothing means 135*a* designates a part of or all of the pitch name indicators, among the indicators 20*a*-20*l*, between the indicator which corresponds to the previous reference pitch name Nb and the indicator which corresponds to the current reference pitch name N as targets and lights one of the target indicators sequentially in the variation direction of the pitch per predetermined time (in this exemplary embodiment, 50 ms) within the range of an interval of pitch detection (200 ms) of the pitch detection means 132. Accordingly, the change of the input sound from the pitch name Nb to the pitch name N is shown by a movement direction of the lighting of the indicators on the pitch name display 20.

Figure 11:
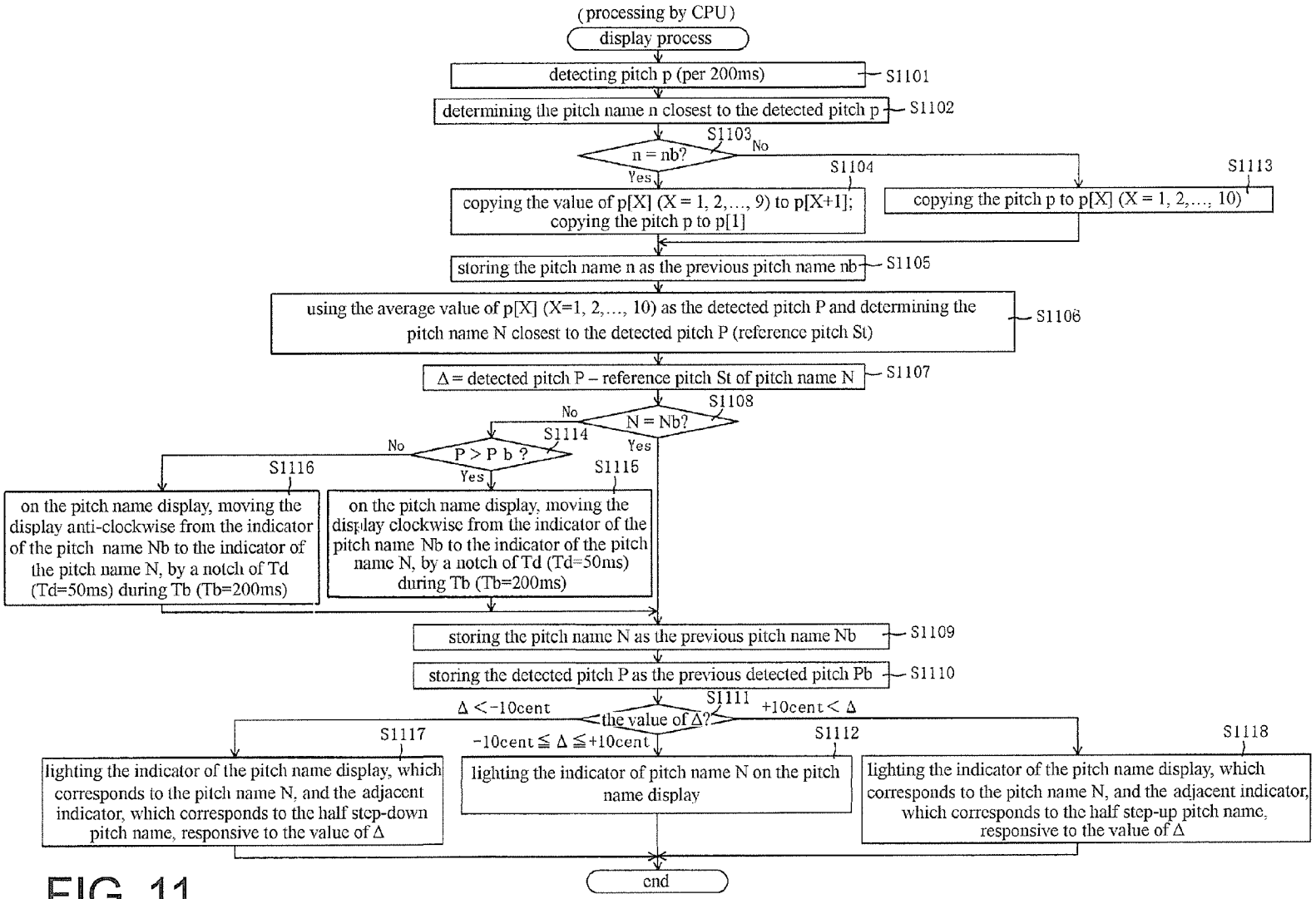
FIG. 11 is a flowchart illustrating the display process of the second exemplary embodiment.

FIG. 11 is a flowchart illustrating the display process performed by the CPU 11 of the tuning device 1 of the second exemplary embodiment. The same as the first exemplary embodiment, the display process of the second exemplary embodiment is also initiated upon input of the instruction of starting the tuning process for the mixture sound, and this process is executed repeatedly at predetermined time intervals (in this exemplary embodiment, per 200 ms).

First, the CPU 11 detects the pitch p of the input sound (S1101). In this exemplary embodiment, the process is carried out every 200 ms, and therefore the detection of the pitch p is also performed every 200 ms. Next, the CPU 11 determines a pitch name n that is closest to the detected pitch p (S1102) and judges whether the pitch name n is identical to a previous pitch name nb, which is the previous pitch name n (S1103).

In S1103, if the CPU 11 determines that the pitch name n and the pitch name nb are the same (S1103: Yes), the CPU 11 copies a value of p[X] that is stored in the RAM 13 (X=1, 2, . . . 9) to p[X+1] and copies the pitch p to p[1] (S1104). p[X] refers to various areas provided in the RAM 13 for individually storing X pitches p that are respectively detected in S1101. In other words, p[X] can only store the pitches p that are detected in the past X times at maximum. In this exemplary embodiment, X=1-10.

In addition, in S1103, if the CPU 11 determines that the pitch name n is different from the pitch name nb (S1103: No), the pitch p is copied to p[X] (X=1, 2, . . . 10) (S1103). In other words, when the pitch name n and the pitch name nb are different, the value of p[X] is all equal to the pitch p from X=1 through X=10.

After the process of S1104 or S1113, the CPU 11 stores the pitch name n in the RAM 13 as the previous pitch name nb (S1105). Then, the CPU 11 uses the average value of p[X] (X=1, 2, . . . 10) as the detected pitch P, and determines the pitch name N that is closest to the detected pitch P as the reference pitch name and determines the reference pitch St corresponding to the pitch name N (S1106). Thereafter, the CPU 11 calculates a difference Δ in the unit of cent by subtracting the reference pitch St of the pitch name N from the detected pitch P (S1107).

Following that, the CPU 11 determines whether the pitch name N is identical to a previous pitch name Nb, which is the previous pitch name N (S1108). In S1108, if the CPU 11 determines that the pitch name N is different from the previous pitch name N (S1108: No), the CPU 11 determines whether the detected pitch P is larger than a previous pitch Pb, which is the previous detected pitch P (S1114).

In S1114, if the CPU 11 determines that the detected pitch P is larger than the previous pitch Pb (S1114: Yes), the CPU 11 switches the lighting of the pitch name display 20 clockwise from the indicator, among the indicators 20*a*-20*l*, which corresponds to the previous pitch name Nb, to the indicator, which corresponds to the pitch name N, by each lighting time difference Td (Td=50 ms) during the transition display time Tb (Tb=200 ms) (S1115). Through the process of S1115, the lighting time of each indicator is set to T (in this exemplary embodiment, 50 ms, which is equal to the lighting time difference Td), and while lighting is switched clockwise between the indicators, the indicator corresponding to the pitch name N is lighted after the transition display time Tb (in this exemplary embodiment, 200 ms). The transition display of the indicator in the process of S1115 is exemplified by FIG. 12A which will be described later.

Moreover, in S1114, if the CPU 11 determines that the detected pitch P is smaller than the previous pitch Pb (S1114: No), the CPU 11 switches the lighting of the pitch name display 20 anti-clockwise from the indicator, among the indicators 20*a*-20*l*, which corresponds to the previous pitch name Nb, to the indicator, which corresponds to the pitch name N, by each lighting time difference Td (Td=50 ms) during the transition display time Tb (Tb=200 ms) (S1116). Through the process of S1116, the lighting time of each indicator is set to T (ms), and while lighting is switched anti-clockwise between the indicators, the indicator corresponding to the pitch name N is lighted after the transition display time Tb (ms). The transition display of the indicator in the process of S1116 is exemplified by FIG. 12B which will be described later.

After the process of S1115 or S1116, the CPU 11 carries on the process to S1109. In S1108, if the CPU 11 determines that the pitch name N and the previous pitch name N are identical to each other (S1108: Yes), the CPU 11 also carries on the process to S1109. In S1109, the CPU 11 stores the pitch name N as the previous pitch name Nb in the RAM 13. Then, the CPU 11 stores the detected pitch P as the previous pitch Pb in the RAM 13 (S1110).

Then, the CPU 11 determines the value of A that is obtained in S1107 (S1111). In S1111, if the CPU 11 determines that the value of Δ is in the range of −10 cent≤Δ≤+10 cent (S1111: −10 cent≤Δ≤+10 cent), the CPU 11 outputs control information to the driver 16 to make the indicator of the pitch name display 20, which corresponds to the pitch name N, emit red light at the luminance of 100% (S1112) and ends the process.

In S1111, if the CPU 11 determines that the value of Δ satisfies Δ<−10 cent (S1111: Δ<−10 cent), the CPU 11 outputs control information to the driver 16 to make the indicator of the pitch name display 20, which corresponds to the pitch name N, and the adjacent indicator, which corresponds to the half step-down pitch, emit red light at the luminance responsive to the value of Δ (S1117) and ends the process. In S1117, the luminances of the two indicators are determined in accordance with the relationship illustrated by the graph of FIG. 3.

Moreover, in S1111, if the CPU 11 determines that the value of Δ satisfies +10 cent<Δ (S1111: +10 cent<Δ), the CPU 11 outputs control information to the driver 16 to make the indicator of the pitch name display 20, which corresponds to the pitch name N, and the adjacent indicator, which corresponds to the half step-up pitch, emit red light at the luminance responsive to the value of Δ (S1118) and ends the process. In S1118, the luminances of the two indicators are determined in accordance with the relationship illustrated by the graph of FIG. 3.

Here, a specific example of the pitch name transition display of the processes of S1115 and S1116 in the display process of FIG. 11 is explained with reference to FIG. 12A and FIG. 12B. FIG. 12A is a diagram illustrating the pitch name transition display of the process of S1115, namely, transition display of a pitch name of a rising pitch. By contrast, FIG. 12B is a diagram illustrating the pitch name transition display of the process of S1116, namely, transition display of a pitch name of a falling pitch. FIG. 12A and FIG. 12B show the pitch name of the indicator that is lighted every 50 ms, i.e. the lighting time difference Td, when the pitch name is changed from the previous pitch name Nb, e.g. "C," to the current pitch name N, e.g. "C♯" to "C (of a higher octave)."

As shown in FIG. 12A, in the case that the pitch of the input sound rises from the previous pitch name Nb, a part of or all of the indicators, which are among the indicators 20*a*-20*l* and located between the indicator corresponding to the previous pitch name Nb and the indicator corresponding to the pitch name N, are sequentially lighted per 50 ms (the lighting time difference Td), clockwise starting from the indicator corresponding to the previous pitch name Nb, namely, in a direction that the pitch name varies to the high side with the previous pitch name Nb as the reference. Moreover, as shown in FIG. 12B, in the case that the pitch of the input sound falls from the previous pitch name Nb, a part of or all of the indicators, which are among the indicators 20*a*-20*l* and located between the indicator corresponding to the previous pitch name Nb and the indicator corresponding to the pitch name N, are sequentially lighted per 50 ms (the lighting time difference Td), anti-clockwise starting from the indicator corresponding to the previous pitch name Nb, namely, in a direction that the pitch name varies to the low side with the previous pitch name Nb as the reference. No matter the pitch of the input sound rises or falls, the indicator corresponding to the pitch name N is lighted eventually when the transition display time Tb of 200 ms lapses. Therefore, the user can know the variation direction of the pitch of the input sound from the movement direction of the transition display.

Moreover, a movement speed of the transition display increases as the pitch difference between the previous pitch name Nb and the pitch name N increases, namely, the number of the indicators located between the indicator corresponding to the previous pitch name Nb and the indicator corresponding to the pitch name N increases. Thus, the user can know the degree of pitch variation of the input sound from the movement speed of the transition display.

According to the above descriptions, the tuning device 1 of the second exemplary embodiment can display how the input sound varies from the previous pitch name Nb to the pitch name N by the movement direction of the indicators that are lighted on the pitch name display 20, which allows the user to easily understand pitch variation of the input sound visually.

In addition, the tuning device 1 of the second exemplary embodiment smoothens the pitches detected from the input sound in S1106, and therefore can reduce pitch swing that occurs near the reference pitch name. When a singer sings at a certain pitch during vocal performance, the display of the pitch name display 20 may swing due to the degree of vibrato shaking. The configuration of the second exemplary embodiment can suppress such display swing.

The above illustrates the invention with reference to the exemplary embodiments. However, it should be understood that the invention is not limited to any of these exemplary embodiments, and various modifications or alterations may be made without departing from the spirit of the invention.

For instance, the values given in the aforementioned exemplary embodiments are merely examples, and other values may also be adopted for the invention.

In the aforementioned exemplary embodiments, the indicators 20*a*-20*l* of the pitch name display 20 are arranged circumferentially. Nevertheless, the arrangement of the indicators 20*a*-20*l* is not limited thereto, and the indicators 20*a*-20*l* may be arranged in various circular forms, which put two end pitch names (e.g. pitch names "C" and "B") of a pitch name sequence that includes twelve pitches of one octave adjacent to each other. For example, the twelve indicators 20*a*-20*l* may be arranged in an elliptical form or a polygonal form, such as hexangular or dodecagonal arrangement, etc. Moreover, the indicators 20*a*-20*l* of the pitch name display 20 may also be arranged linearly.

In the aforementioned exemplary embodiments, the indicators 20*a*-20*l* of the pitch name display 20 are lighted using LEDs as the light source. However, the pitch name display may also be displayed on a display, such as an LCD, and include twelve circumferentially-arranged indicators to respectively serve as the indicators 20*a*-20*l*, and the same as the aforementioned exemplary embodiments, the indicators may be respectively lighted at the luminance corresponding to the difference between the reference pitch and the pitch of the sound that is to be tuned. For such an arrangement, the display positions of the twelve indicators can be properly changed according to the scale and the reference pitch name.

In the aforementioned exemplary embodiments, the form of decreasing or increasing of the luminance responsive to the pitch variation of the input sound is a linear variation as shown in the graph of FIG. 3; however, it may also be a curved variation.

In the aforementioned exemplary embodiments, the brightness of the indicators 20*a*-20*l* of the pitch name display 20 is presented by the unit of "luminance." However, the brightness may also be presented by units, such as "illumination" or "luminosity," etc. Moreover, in the aforementioned exemplary embodiments, the luminance of 100% is exemplified as the brightest luminance (maximum luminance); however, a luminance other than 100% may also be used as the relatively brightest luminance. Regarding the luminance other than 100%, for example, the maximum luminance may be set to 80%, and when displaying the input sound whose pitch is varying, once the pitch is not changed and maintained a certain pitch after a while, only the indicator of the pitch name corresponding to the pitch of the input sound or all the indicators at the luminance of 100% flash by showing an alarm, for example, to inform the user that the pitch is stable.

In the aforementioned first exemplary embodiment, among the indicators 20*a*-20*l*, the indicators that respectively correspond to the first sound and the second sound which constitute the mixture sound may be lighted with the same (red color) or different light colors. In addition, the lighting forms of the indicators that respectively correspond to the first sound and the second sound may also be distinguished from each other by light-on/light-off time of the LEDs, the lighting interval (the length of light-off time), etc. Moreover, more than one pitch name display 20 may be installed for respectively displaying each sound that constitutes the mixture sound. Nevertheless, as described in the first exemplary embodiment, the configuration of displaying pitch names of two sounds on one pitch name display 20 allows the user to easily know the pitch name display that the user should look at and therefore is preferred.

In the aforementioned first exemplary embodiment, the form of notifying the relationship between the relative pitch difference of the two sounds of the mixture sound and the reference interval corresponding to the equal temperament scale or the just intonation scale is exemplified by the auxiliary display 21 that includes the ♯ indicator 21*a* and the ♭ indicator 21*b*. However, various notification forms may be adopted. For example, notifications through audio or display of words or symbols on an LCD, etc., may also be used.

In the aforementioned first exemplary embodiment, when the value of Δc is in the range of ±5 cent with a value corresponding to the X semitone difference (X is an integer equal to or larger than 0) as the center, both of the ♯ indicator 21*a* and the ♭ indicator 21*b* are lighted. Nevertheless, the user may be notified in a different way when the value of Δc is in a narrower range with the value corresponding to the X semitone difference as the center. For instance, when the value of Δc is in a range narrower than the range of ±5 cent with the value corresponding to the X semitone difference as the center, the ♯ indicator 21*a* and the ♭ indicator 21*b* may emit lights of different colors. Moreover, the pitch range with the value corresponding to the X semitone difference as the center, in which both of the ♯ indicator 21*a* and the ♭ indicator 21*b* are lighted, is not fixed to ±5 cent and may be varied according to the user's proficiency of pitch control. For a beginner who finds pitch control difficult, pitch determination may be loosened. For example, the range may be set to ±15 cent for the beginner to start with rough pitch control in order to light both of the ♯ indicator 21*a* and the ♭ indicator 21*b*. Once the beginner improves, the range may be set to ±5 cent to monitor pitch control more strictly. Like this, step by step, the user can practice pitch control efficiently.

In the aforementioned first exemplary embodiment, the pitch name of the input sound or the lighting form of the auxiliary display 21 is determined with reference to the pitch name determining table 12*a* or the auxiliary display table 12*b*. However, the reference pitch of each sound may be calculated respectively and be used as a basis for determining the pitch name of the input sound or the lighting form of the auxiliary display 21, and in such a case, the aforementioned tables 12*a* and 12*b* are not used.

In the aforementioned first exemplary embodiment, a pitch name determining table and an auxiliary display table are prepared according to the equal temperament or just intonation major to serve as the pitch name determining table 14*a* and the auxiliary display table 14*b*. However, in addition thereto, a pitch name determining table and an auxiliary display table may also be prepared according to a just intonation minor. In such a case, for the just intonation mode that may be selected by means of the mode selection operator 37, a mode of selecting the major and a mode of selecting the minor may be provided.

In the aforementioned first exemplary embodiment, a matching degree of the pitch difference of the detected two sounds relative to the reference interval corresponding to the equal temperament scale or the just intonation scale is displayed by the auxiliary display 21. However, the scale (rhythm) applicable to the invention is not limited to the aforementioned equal temperament scale and just intonation scale. For example, Kirnberger temperament, Pythagorean temperament, meantone temperament, Berg Meister temperament, etc., may be used in replacement of the just intonation scale. In other words, among the pitches of the detected two sounds, the reference pitch of the pitch name corresponding to the pitch of one sound may be determined according to the equal temperament scale, and the pitch name corresponding to the pitch of the other sound may be determined as the pitch name closest to the pitch of the other sound based on Kirnberger temperament, etc., instead of the just intonation scale. Moreover, the "predetermined scale" mentioned in the claims is not limited to the equal temperament scale or the just intonation scale exemplified in the first exemplary embodiment and may cover any suitable rhythm (e.g. Kirnberger temperament, Pythagorean temperament, meantone temperament, Berg Meister temperament, etc.) that may replace the just intonation scale.

In the aforementioned second exemplary embodiment, a time interval (200 ms) for detecting the pitch of the input sound and the transition display time Tb are equal. However, these times may be different from each other. In addition, in the aforementioned exemplary embodiment, the indicators are lighted on a condition that the lighting time difference Td is equal to 50 ms (Td=50 ms), the lighting time T of each indicator is equal to 50 ms (T=50 ms), and the lighting time difference Td is equal to the lighting time T (Td=T). However, the value may be varied properly. The relationship between the lighting time difference Td and the lighting time T is not limited to Td=T, as exemplified in the aforementioned second exemplary embodiment, and may also be Td<T or Td>T. For example, to make the transition display of the pitch name more clear, the lighting time difference Td may be further reduced, the number of the indicators that are lighted in the transition display time Tb (lighting frequency) may be increased, and the lighting time T of the lighted indicator may be made longer. Referring to FIG. 12A as one of the examples, in the case that the lighting time difference Td is 40 ms (Td=40 ms), in the transition display time Tb of 200 ms (Tb=200 ms), five indicators are lighted during the transition from the previous pitch name Nb to the pitch name N, which include 40 ms (1×Td), after 80 ms (2×Td), after 120 ms (3×Td), after 160 ms (4×Td), and after 200 ms (5×Td). That is to say, in comparison with the situation that the lighting time difference Td is 50 ms (Td=50 ms) as exemplified in the second exemplary embodiment, the lighting frequency is higher and delicate transition display can be achieved when the lighting time difference Td is 40 ms (Td=40 ms). Moreover, by increasing the lighting time T, the transition state of the pitch name can be displayed more clearly for visual checking. For instance, if the lighting time T is made longer (e.g. T=60 ms) than 50 ms exemplified in the second exemplary embodiment, the total lighting time of the indicators during the transition display time Tb of 200 ms can be increased, and accordingly, the transition state of the pitch name can be displayed more clearly for visual checking. In addition, by increasing the transition display time Tb, the lighting frequency in the transition display time Tb can be increased and the lighting time T of the lighted indicators also becomes longer. Thus, the transition of the pitch name can be displayed more clearly.

In the aforementioned second exemplary embodiment, the transition of pitch name is displayed by the pitch name display 20. However, an exclusive display may be installed for performing the transition display. Moreover, in the aforementioned exemplary embodiments, the indicators are lighted one by one during the transition display time Tb; however, more than one indicator may be lighted at the same time.

What is claimed is:

1. A tuning device, comprising:

an input means capable of inputting at least one sound;

a pitch detection means capable of detecting at least two pitches independently from a mixture of two sounds inputted by the input means, wherein the two sounds are produced simultaneously;

a first pitch name determining means determining a pitch name that is closest to one of the at least two pitches detected by the pitch detection means, as a first pitch name according to an equal temperament scale;

a second pitch name determining means determining a pitch name that is closest to a target pitch, which is a pitch different from the one pitch of the at least two pitches detected by the pitch detection means, as a second pitch name according to a predetermined scale;

a pitch name display means capable of displaying the first pitch name and the second pitch name; and a notification means capable of notifying information about a relative pitch difference value of a first pitch corresponding to the first pitch name and a second pitch corresponding to the second pitch name, which are among the at least two pitches detected by the pitch detection means.

2. The tuning device according to claim 1, wherein the predetermined scale is a just intonation scale that uses the first pitch name as a keynote.

3. The tuning device according to claim 2, further comprising a notification control means that controls a notification performed by the notification means, wherein, when the relative pitch difference value exceeds a predetermined range with a closest interval as the center, wherein the closest interval is closest to the relative pitch difference value among first reference intervals that are between a reference pitch of a keynote according to the just intonation scale and a reference pitch of a random pitch name other than the keynote of the just intonation scale, the notification control means controls the notification means to perform a distinguishable notification notifying whether the relative pitch difference value is larger than or smaller than the closest interval.

4. The tuning device according to claim 3, wherein the notification control means controls the notification means to perform a predetermined notification that is different from the distinguishable notification when the relative pitch difference value is in the predetermined range.

5. The tuning device according to claim 1, wherein the predetermined scale is an equal temperament scale.

6. The tuning device according to claim 5, further comprising a notification control means that controls the notification performed by the notification means, wherein, when the relative pitch difference value exceeds a predetermined range with a closest interval as the center, wherein the closest interval is closest to the relative pitch difference value among second reference intervals that are between reference pitches of two random pitch names according to the equal temperament scale, the notification control means controls the notification means to perform a distinguishable notification notifying whether the relative pitch difference value is larger than or smaller than the closest interval.

7. The tuning device according to claim 6, wherein the notification control means controls the notification means to perform a predetermined notification that is different from the distinguishable notification when the relative pitch difference value is in the predetermined range.

8. The tuning device according to claim 1, wherein the pitch name display means displays the first pitch name and the second pitch name in different forms.

* * * * *